US009657984B2

(12) United States Patent
Wang et al.

(10) Patent No.: US 9,657,984 B2
(45) **Date of Patent: *May 23, 2017**

(54) REFRIGERATOR

(71) Applicant: HISENSE RONSHEN (GUANGDONG) REFRIGERATOR CO., LTD., Guangdong (CN)

(72) Inventors: Meiyan Wang, Guangdong (CN); Dong Kong, Guangdong (CN); Feiyue You, Guangdong (CN)

(73) Assignee: HISENSE RONSHEN (GUANGDONG) REFRIGERATOR CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/853,655

(22) Filed: Sep. 14, 2015

(65) Prior Publication Data

US 2016/0003520 A1 Jan. 7, 2016

Related U.S. Application Data

(63) Continuation of application No. PCT/CN2014/084144, filed on Aug. 12, 2014.

(30) Foreign Application Priority Data

May 14, 2014 (CN) ..... 2014 1 0204058

(51) Int. Cl.
*F25D 23/02* (2006.01)
*F25D 25/02* (2006.01)
(Continued)

(52) U.S. Cl.
CPC ..... *F25D 23/028* (2013.01); *F25D 23/04* (2013.01); *F25D 23/067* (2013.01); *F25D 25/02* (2013.01); *F25D 25/04* (2013.01)

(58) Field of Classification Search
CPC ..... F25D 23/02; F25D 23/04; F25D 25/005; F25D 25/02; F25D 25/021; F25D 25/022;
(Continued)

(56) References Cited

U.S. PATENT DOCUMENTS 1,257,998 A * 3/1918 Gruber ..... E05C 1/14 292/170
3,441,331 A * 4/1969 Kesling ..... A47B 88/12 104/283
(Continued)

FOREIGN PATENT DOCUMENTS

CN 101889183 A 11/2010
CN 102016466 A 4/2011
(Continued)

OTHER PUBLICATIONS

State Intellectual Property Office (ISA/SIPO). 2015. International Search Report mailed Feb. 17, 2015 for PCT Application PCT/CN2014/084144.

*Primary Examiner* — Andrew Roersma
(74) *Attorney, Agent, or Firm* — McDermott Will & Emery LLP

(57) ABSTRACT

The present disclosure relates to the field of refrigerator equipment, in particular to a refrigerator having a height-adjustable rack, comprising a door, a guide rail on the door, adjusting grooves arranged on the guide rail, a rack and a reset device. The rack is assembled on the guide rail through a guide groove and is able to move vertically. A manipulating member and a stop block, which are interlocked, are further movably provided on the rack.

16 Claims, 20 Drawing Sheets

(51) Int. Cl.
*F25D 23/04* (2006.01)
*F25D 23/06* (2006.01)
*F25D 25/04* (2006.01)

(58) Field of Classification Search
CPC ..... A47B 57/06; A47B 57/10; A47B 57/12; A47B 57/14; A47B 57/16; A47B 57/20; A47B 57/48; A47B 57/482; A47B 57/485; A47B 57/487
See application file for complete search history.

(56) References Cited

U.S. PATENT DOCUMENTS

| | | | | | |
|---|---|---|---|---|---|
| 3,603,657 | A * | 9/1971 | Hassay | F25D 23/04 | 312/321.5 |
| 5,346,299 | A | 9/1994 | Werkmeister et al. | | |
| 6,406,109 | B1 * | 6/2002 | Arnal | G11B 15/68 | 312/333 |
| 2005/0061007 | A1 * | 3/2005 | Faber | A47F 1/06 | 62/63 |
| 2007/0159041 | A1 * | 7/2007 | Lucas | F25D 23/067 | 312/408 |
| 2008/0000052 | A1 * | 1/2008 | Hong | E05B 17/0033 | 16/382 |
| 2008/0078201 | A1 * | 4/2008 | Olefson | A47B 96/025 | 62/465 |
| 2010/0117502 | A1 * | 5/2010 | Kang | F25D 25/02 | 312/408 |
| 2011/0273070 | A1 * | 11/2011 | Shin | F25D 23/028 | 312/405 |
| 2015/0330700 | A1 * | 11/2015 | Celik | F25D 23/04 | 312/405.1 |

FOREIGN PATENT DOCUMENTS

| | | | | | |
|---|---|---|---|---|---|
| CN | 102313433 | A | | 1/2012 | |
| CN | 102338525 | A | | 2/2012 | |
| CN | 202166271 | U | | 3/2012 | |
| CN | 102564039 | A | | 7/2012 | |
| CN | 202494257 | U | * | 10/2012 | F25D 17/04 |
| CN | 102997580 | A | | 3/2013 | |
| CN | 103459953 | A | | 12/2013 | |
| CN | 104006618 | A | | 8/2014 | |
| CN | 104006620 | A | | 8/2014 | |
| CN | 203857742 | U | | 10/2014 | |
| CN | 204006937 | U | | 12/2014 | |
| CN | 204006938 | U | | 12/2014 | |
| DE | 102008014885 | A1 | * | 9/2009 | F25D 23/04 |
| DE | WO2009115133 | A1 | * | 9/2009 | F25D 23/04 |
| DE | 102009046612 | A1 | * | 5/2011 | F25D 23/04 |
| DE | 102011006261 | A1 | * | 10/2012 | F25D 23/028 |
| EP | 2108907 | A1 | * | 10/2009 | F25D 23/04 |
| EP | 2354732 | A2 | * | 8/2011 | F25D 23/04 |
| KR | 100392393 | B1 | * | 7/2003 | F25D 23/04 |
| TR | WO2007113263 | A1 | * | 10/2007 | F25D 25/02 |
| TR | EP2250928 | A1 | * | 11/2010 | F25D 25/02 |
| WO | WO2009071341 | A1 | * | 6/2009 | F25D 23/04 |
| WO | WO2012062883 | A2 | | 5/2012 | |
| WO | WO2012062883 | A3 | | 8/2012 | |
| WO | WO2012110393 | A1 | * | 8/2012 | F25D 25/02 |
| WO | WO2012120045 | A2 | * | 9/2012 | F25D 23/04 |
| WO | WO2015021864 | A1 | * | 2/2015 | F25D 25/02 |

* cited by examiner

REFRIGERATOR

CROSS REFERENCE TO RELATED APPLICATIONS

This application is a Continuation Application of PCT/CN2014/084144 filed Aug. 12, 2014, which claims the benefit and priority of Chinese Patent Application No. 201410204058.8, filed on May 14, 2014. The subject matter of each is incorporated herein by reference in entirety.

FIELD

The present disclosure relates to the field of refrigerator equipment, in particular to a refrigerator having a height-adjustable rack.

BACKGROUND

In daily life, people mainly use refrigerators to refrigerate and store foods, so the capacity ratio inside a refrigerator is an important index of the refrigerator. The capacity ratio refers to a ratio of a space that is actually available for placement of articles inside the refrigerator to a total space inside the refrigerator. However, to further increase the capacity ratio of a refrigerator, generally, racks are additionally provided on the inner side of a refrigerator door, so that foods may be placed within the racks and the capacity ratio of the refrigerator is thus increased. In a present mainstream refrigerator structure, a plurality of vertically-arranged snap joints having a fixed height are generally provided on the inner side of the refrigerator door, racks are provided at heights corresponding to the snap joints, and one side of each of the racks is snapped with the snap joints and fixed at a certain height on the inner side of the refrigerator door. Therefore, the racks are vertically arranged and spaced apart from each other by a certain distance, and in this way, more foods may be stored on the racks. However, since the height of the racks is limited by that of the snap joints and thus fixed, a high article has to be horizontally placed in a rack due to the limited distance between the racks. As a result, the inner space of the whole rack is occupied, and the utilization ratio is reduced.

SUMMARY

The present disclosure employs the following technical solutions.

A refrigerator, comprising:

a door on which a guide rail extending vertically is provided, a number of adjusting grooves being formed on the guide rail;

a rack on which a guide groove assembled on the guide rail is provided, the rack being able to move along the guide rail; and a reset device provided on the rack, the reset device driving the stop block to enter an adjusting groove;

wherein a manipulating member and a stop block, which are interlocked, are further movably provided on the rack.

DETAILED DESCRIPTION

The present disclosure will be further described below with reference to specific implementations. The accompanying drawings are merely exemplarily illustrative, representing schematic diagrams but not physical diagrams, and shall not be regarded as limiting the present patent. In order to better describe the embodiments of the present disclosure, some elements in the accompanying drawings will be omitted, enlarged or reduced, and such elements in the accompanying drawings do not represent the real size of products. It should be understood by those skilled in the art that some well-known structures in the accompanying drawings and description thereof may be omitted.

Identical or similar reference numbers in the accompanying drawings in the embodiments of the present disclosure correspond to identical or similar elements. In the description of the present disclosure, it should be understood that the orientation or position relationship indicated by terms such as "up", "down", "left", "right", "vertical" and "horizontal" is an orientation or position relationship shown based on the accompanying drawings, which is merely used for conveniently describing the present disclosure and simplifying the description, rather than indicating or implying that the device or element must have a particular orientation or must be constructed and operated in a particular orientation. Therefore, the terms for describing the position relationships in the accompanying drawings are merely exemplarily illustrative and shall not be regarded as limiting the present patent. It is also noted that, spatial position coordinates are added in the accompanying drawings, and the position description of "front", "rear", "left", "right", "up" and "down" mentioned in the embodiments shall be subject to the spatial position coordinates, for understanding the position relationship and assembly position of parts more clearly.

Embodiment 1

Figure 5:
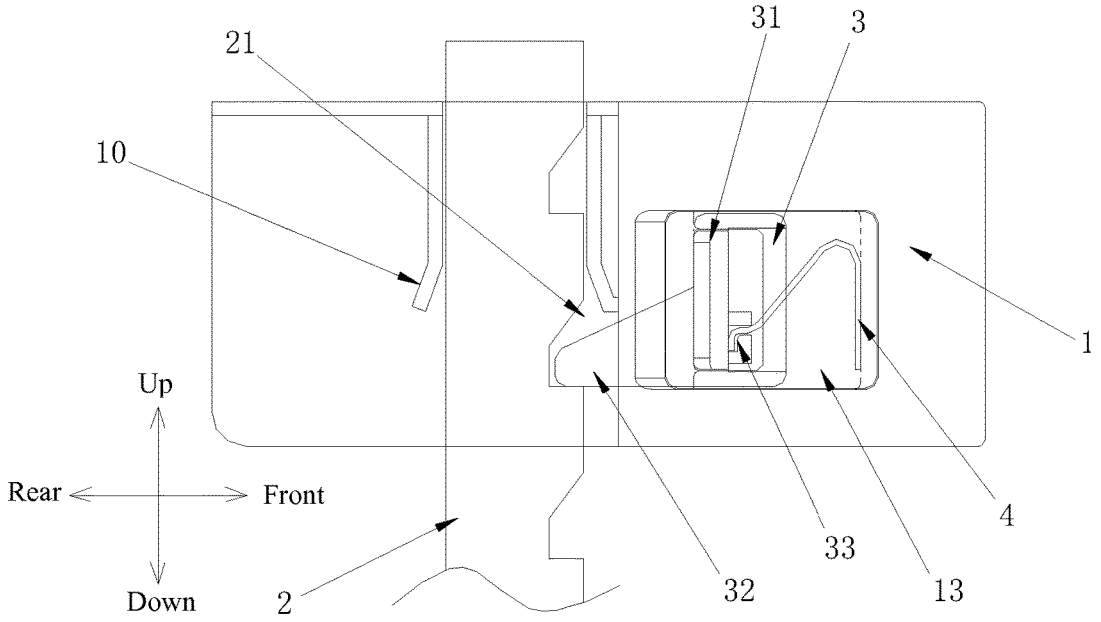
FIG. 5 is a partial view of FIG. 4.

As shown in FIGS. 1-4, a refrigerator is provided, including a door 100 of the refrigerator and a rack 1; a guide rail 2 is integrally formed on the inner wall on one side of the door 100 and extends vertically; and adjusting grooves 21 are vertically arranged on the guide rail 2. A number of limiting ribs 10 extending vertically are integrally formed on one side of the rack 1, and the limiting ribs 10 are spaced apart from each other to form a guide groove 11 extending vertically. A mounting site 13, which is adjacent to the front side of the guide groove 11, is integrally formed on left and right sides of the rack 1, and the rack 1 is assembled on the guide rail 2 through the fit of the guide groove 11 with the guide rail 1. The rack 1 is able to move vertically in a direction of the guide rail 2. It is noted that, in practice, to avoid the inclination of the rack 1 during moving up and down, the guide rail 2 needs to be closely fitted with the guide groove 11. This may be understood by those skilled in the art. With reference to FIG. 5, a manipulating member 3 is assembled within the mounting site 13, and a space for movement is reserved in the front-rear direction of the mounting site 13, so that the manipulating member 3 is able to move front and back within the mounting site 13, while being limited by the mounting site 13 in vertical direction. A handle 31 is extended from the left side of the manipulating member 3. By prodding the handle 31, the manipulating member 3 may be controlled to move front and back within the mounting sites 13. A stop block 32 is connected to the rear side of the manipulating member 3, and the stop block 32 passes through the rear side of the mounting site 13 and extends toward the guide groove 11. A positioning snap 33 is formed within the manipulating member 3, and an elastic element is further mounted within the mounting site 13. The elastic element is a V-shaped spring leaf 4. The front end of the spring leaf 4 is resisted against the front side of the mounting site 13, while the rear end thereof is snapped on the positioning snap 33 inside the manipulating member 3. In the case of not being compressed, a spring leg at the rear end of the spring leaf 4 pushes the manipulating member 3 to the last side of the mounting site 13 and drives the stop block 32 to enter an adjusting groove 21 of the guide rail 2. The adjusting groove 21 supports the stop blocks on the bottom, so that the whole rack 1 may be retained at a certain height of the guide rail 2. Furthermore, as the guide rail 2 is closely fitted with the guide groove 11, the rack 1 will be retained on the guide rail 2 without inclining downward.

In addition, a cover plate 8 is covered on the mounting site. The cover plate is assembled on the mounting site 13 by a reverse snap 82, and a square hole 81 is further formed on the cover plate 8. When the cover plate 8 is mounted well, the square hole 81 corresponds to the position of the handle 31 of the manipulating member 3, and the handle 31 extends out from the square hole 81 and is much higher than the cover plate 8, so that it is convenient for a person to prod the handle 31 by a hand. Meanwhile, after the cover plate 8 is mounted well, the cover plate 8 may limit the manipulating member 3 and the spring leaf 4 on the left side of the mounting site 13, so that the popup of the spring leaf 4 or the manipulating member 3 out from the mounting site 13 during operation is avoided.

Figure 6:
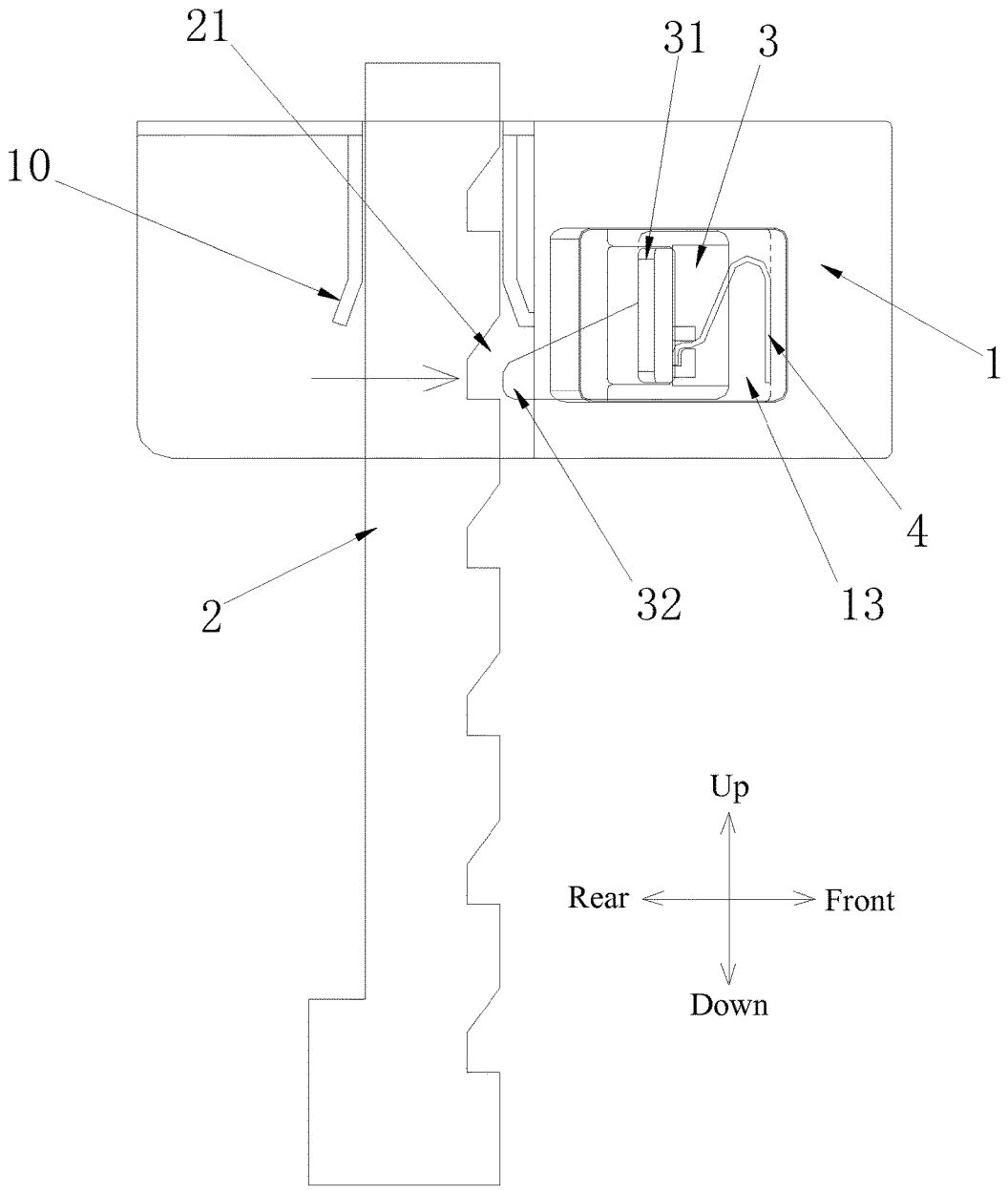
FIG. 6 is a structural diagram when the rack is moved downward after a spring leaf is compressed and a stop block is retreated from an adjusting groove according to Embodiment 1.
Figure 7:
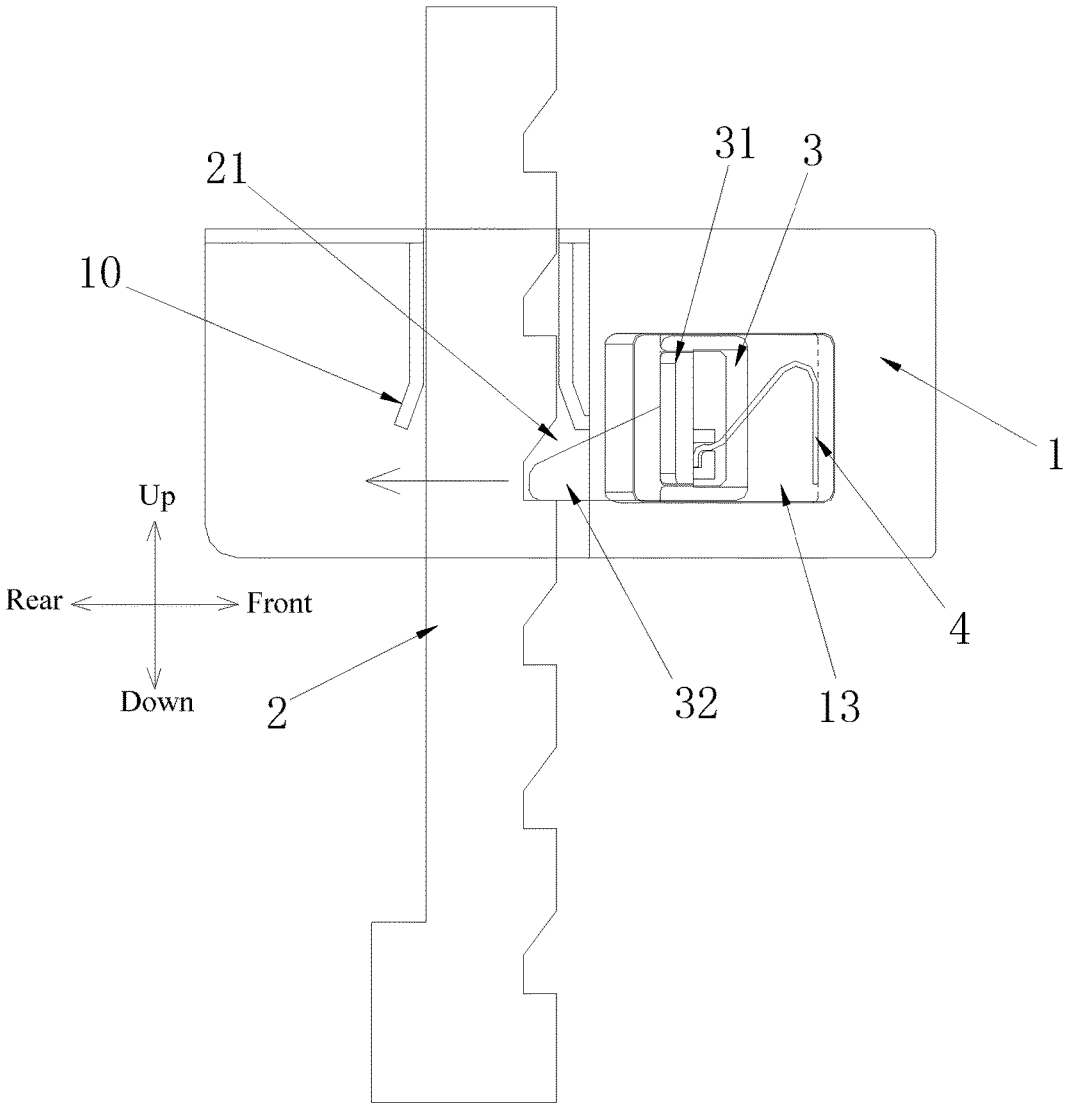
FIG. 7 is an internal structural diagram when the rack is locked at a new height, according to Embodiment 1.
Figure 8:
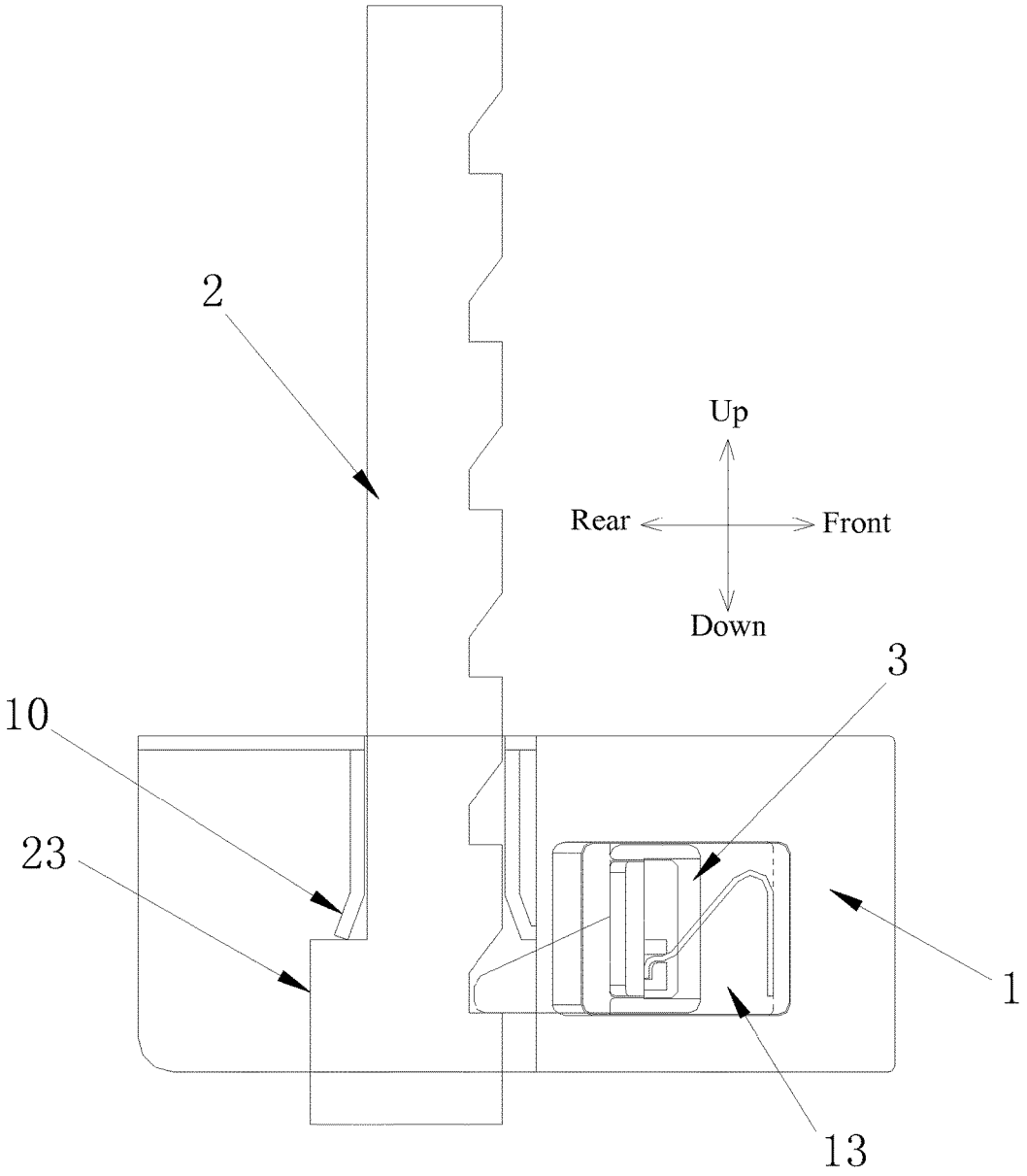
FIG. 8 is a schematic diagram when the rack is moved to a tail end of the guide rail according to Embodiment 1.

As shown FIGS. 5-7, when it is required to adjust the height of the rack 1, the handle 31 is first prodded by a finger to drive the manipulating member 3 to move toward the front side, thus the spring leaf 4 is compressed, and the stop block 32 is moved forward and retreated from the adjusting groove 21, so that the adjusting groove 21 will not support the bottom of the stop block 32 and the rack 1 may be moved at will in vertical direction. When the rack 1 is moved to a proper height, the spring leaf 4 may be reset to push the manipulating member 3 on the front side again and to drive the stop block 32 to enter an adjusting groove 21 again, as long as the finger releases the acting force to the handle 31. The bottom of the stop block 32 is supported by the adjusting groove 21 again and the rack 1 may be thus retained at a new vertical height. Therefore, as the height position of the rack 1 on the door 100 may be adjusted at will, the user may adjust the height position of the rack 1 without taking down the rack 1 from the door 100, so that the problem of inconvenient operation of the rack on the conventional refrigerator door is solved. Furthermore, a high article may be placed on the rack 1 normally by adjusting the distance between racks, instead of being deliberately and horizontally placed on the rack. Hence, the utilization ratio of the space inside the refrigerator is effectively improved.

In addition, it is noted that, in this embodiment, limiting the guide groove 11 by a number of limiting ribs 10 is merely one of implementations; and in practical applications, this may be realized by various structures. For example, the guide groove 11 may be formed by recessing on the rack 1. Such a variation shall be included within the protection scope of the present disclosure.

It is also noted that, in this embodiment, providing the guide rail 2, the adjusting grooves 21, the guide groove 11, the stop block 32, the reset device, the manipulating member and other structures only on one side of the rack 1 is merely one of implementations; and in practical applications, according to the requirements on the bearing capacity of the rack 1, it is optional that the same or similar structures may be concurrently provided on two sides of the rack 1. Such a variation shall be included within the protection scope of the present disclosure.

It is also noted that, in this embodiment, providing the guide rail 2, the adjusting grooves 21, the guide groove 11, the stop block 32, the reset device, the manipulating member and other structures only on one side of the rack 1 is merely one of implementations; and in practical applications, according to the requirements on guide stability, it is optional that a guide rail and a guide groove both merely for a purpose of guiding are provided on the other side of the rack. Such a variation shall be included within the protection scope of the present disclosure.

Embodiment 2

This embodiment further improves and refines Embodiment 1. Since, after the stop block enters an adjusting groove, the adjusting groove may limit the movement of the stop block, particularly, the bottom of the adjusting groove may limit the bottom of the stop block, the rack is locked at a certain height, without falling off due to its weight. The limitation of the adjusting groove to the stop block at the upper part is unnecessary. Therefore, to enable the rack to be moved upward while being locked by the stop block, a driving surface is provided on the upper side of the adjusting groove. With reference to FIGS. 2-5, the upper side of the adjusting groove 21 has a depth value that is gradually increased from up to down and forms a driving surface 22. That is, the structure of the driving surface 22 gradually gets close to the rack from down to up. When the rack 1, along with the stop block 32, gradually rises, the driving surface 22 at the upper part of the adjusting groove 21 may gradually drive the stop block 32 to move forward and thus retreat from the adjusting groove 21, so that the driving surface 22 is able to push the stop block 32 to move as the rack 1 rises. Therefore, in the case where the rack 1 is fixed, i.e., in the case where the manipulating member 3 does not drive the stop block 32 to leave the adjusting groove 21, the user is not required to remove the rack from the refrigerator door 100, and the driving surface 22 may drive the stop block 32 to return into the rack 1 only by controlling the rack 1 to move up. That is, the driving surface 22 gradually drives the stop block 32 to leave the adjusting groove 21 to temporarily unlock the rack 1 and thus enable the rack 1 to move up. This embodiment may be more convenient for a user to quickly adjust the placement height of the rack 1, is easy and simple to operate, and realizes the quick adjustment of the rack 1 such that the rack 1 may be quickly adjusted up and down on the guide rail 2.

Embodiment 3

Figure 1:
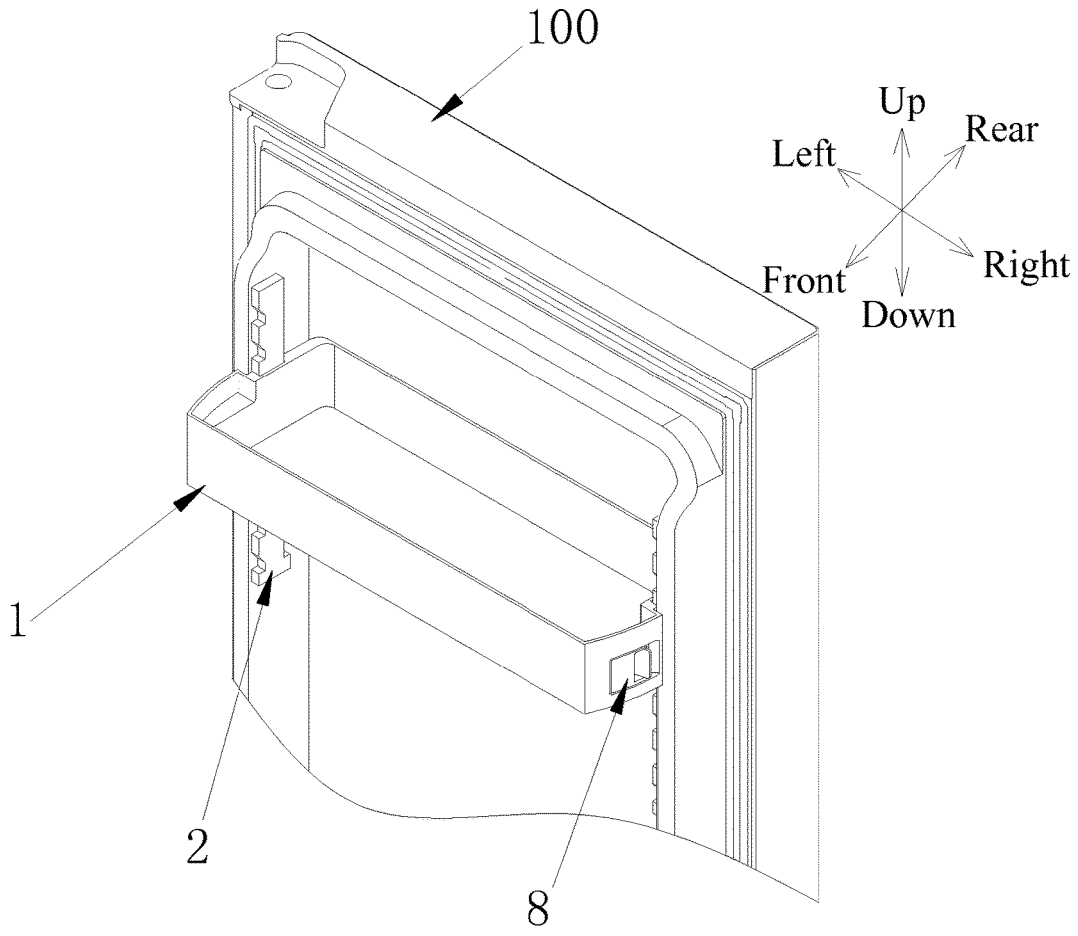
FIG. 1 is an overall structural diagram according to Embodiment 1 of the present disclosure.
Figure 2:
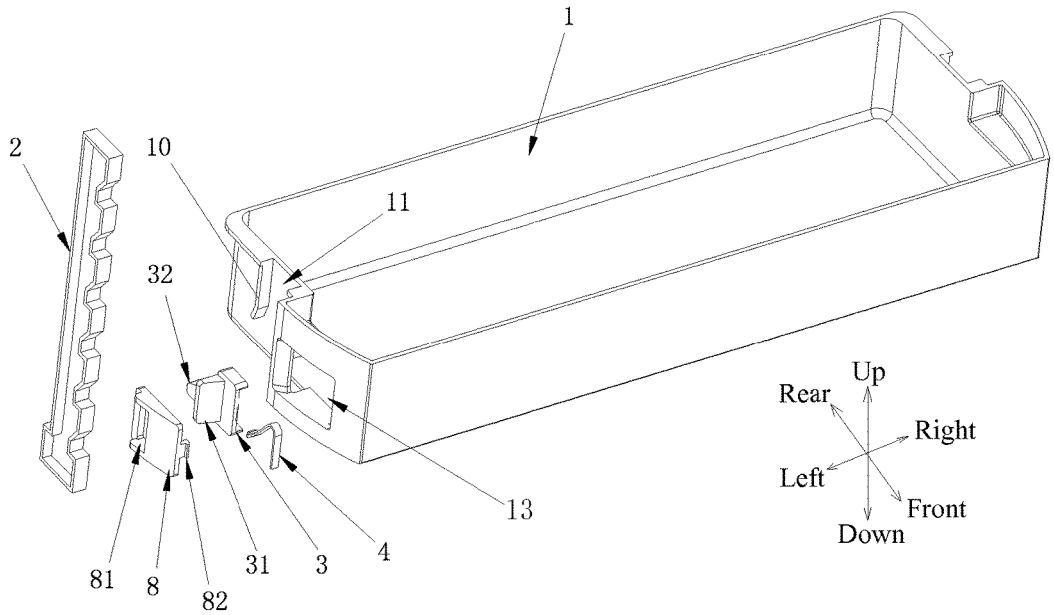
FIG. 2 is an exploded view according to Embodiment 1 of the present disclosure.
Figure 3:
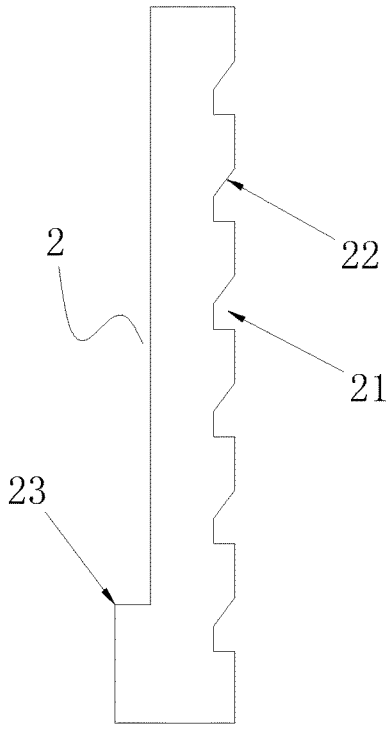
FIG. 3 is a structural diagram of a guide rail according to Embodiment 1 of the present disclosure.
Figure 4:
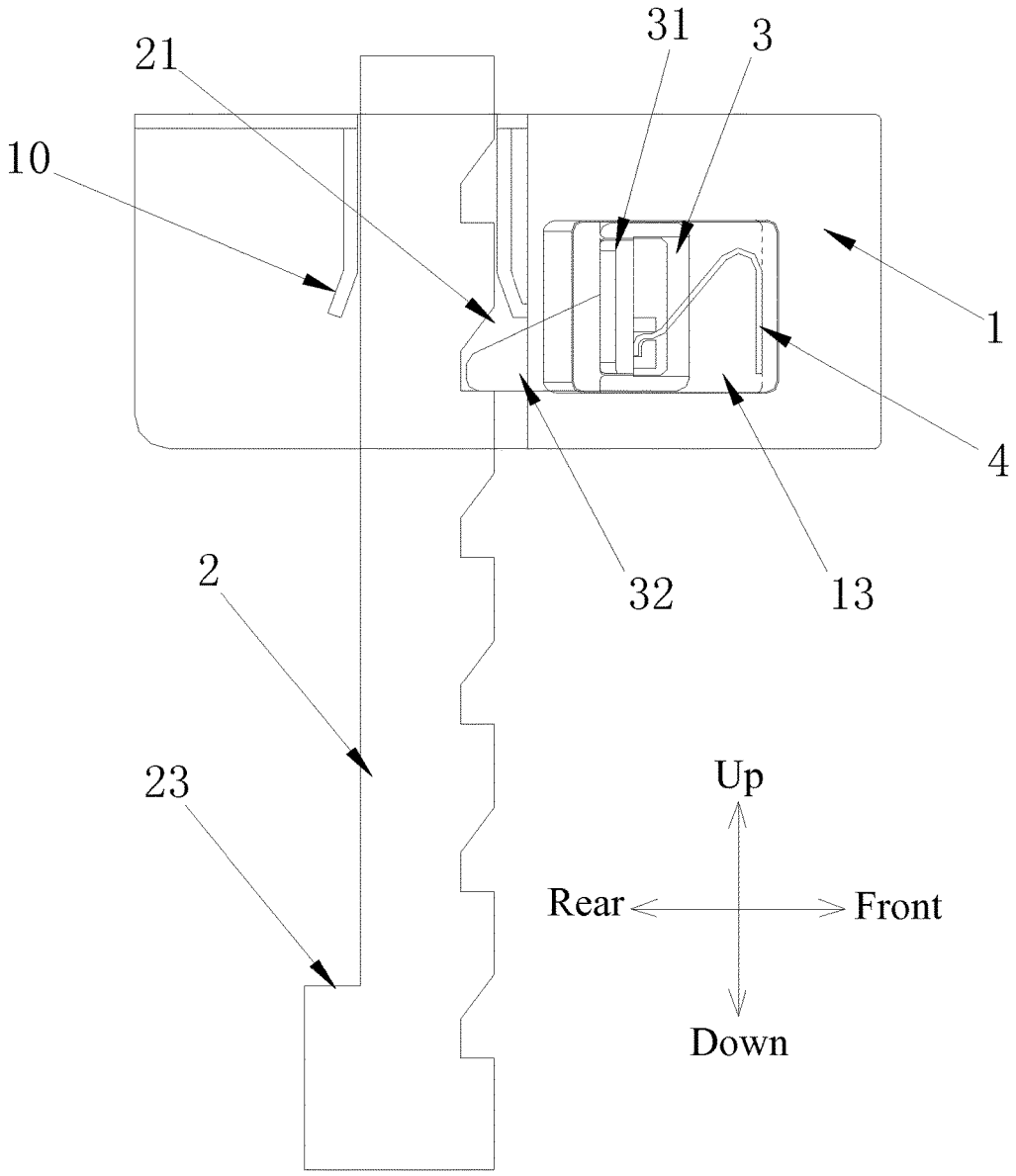
FIG. 4 is an internal structural diagram when a rack is locked at a certain height, according to Embodiment 1.

This embodiment further improves and refines Embodiment 2. As the driving surface 22 is formed in a manner of gradually increasing a depth value of the upper side of the adjusting groove 21 from up to down, the driving surface 22 may be in various shapes, for example, a plane or cambered surface, both of which may realize the driving to the stop block 32 during the rising of the rack 1. However, considering the smoothness of the driving, in this embodiment, as shown in FIG. 3, the driving surface 22 is a plane. The driving surface 22 is a gradually inclined plane, which may make the pushing to the stop block 32 smoother and is also advantageous for the user's feeling of operation.

Embodiment 4

This embodiment further improves and refines Embodiment 3. In order to make the gradual pushing of the driving surface 22 to the stop block 32 smoother and reduce the resistance, as shown in FIG. 5, a rear top side of the stop block 32 is arc-shaped.

Embodiment 5

Figure 10:
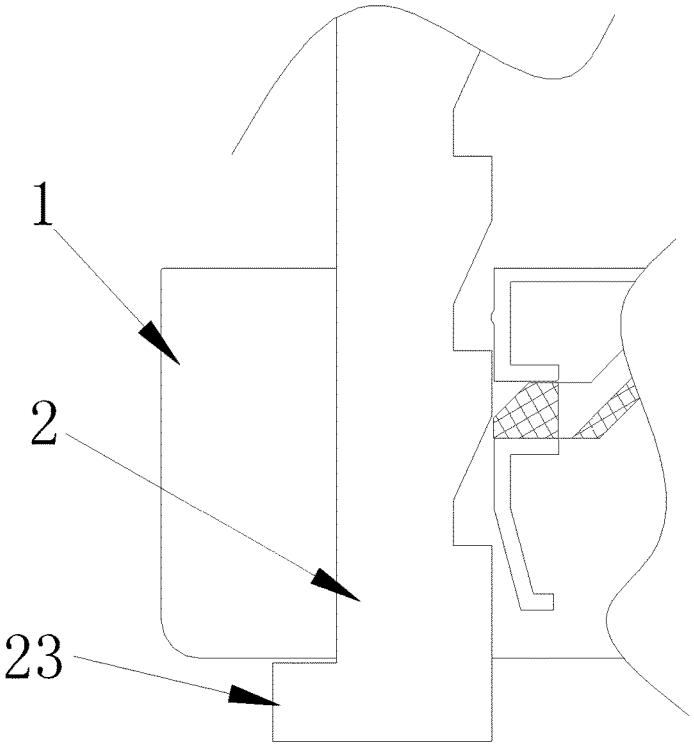
FIG. 10 is a schematic diagram of supporting a locking platform on the bottom of the rack when the guide groove is in a form of a recessing groove.

This embodiment further improves and refines Embodiment 1. As shown in FIG. 2 and FIGS. 6-8, a locking platform 23, which extends outward from the rear side of the guide rail 2 by a certain section, is formed at a lower end of the guide rail 2, and the upper side of the locking platform 23 corresponds to the limiting rib 10 on the rear side of the guide groove 11. Thus, when the rack 1 is moved along the guide rail 2 downward to the tail end of the guide rail 2, the limiting rib 10 will be jammed with the locking platform 23, so that the rack 1 cannot be moved any more; meanwhile, the rack 1 is prevented from falling off due to its weight as supported by the locking platform 23. As a result, it may be ensured that the locking platform 23 may support the rack 1 on the bottom when the movement of the stop block 32 is failed, that is, when the adjusting groove 21 is unable to successfully support the bottom of the limiting block 32. In this case, the rack 1 may serve as a fixed rack to ensure normal use. It is noted that, in this embodiment, jamming the locking platform 23 by the limiting rib 10 is merely one of embodiments; and in practical applications, there are various equivalent structures. For example, when the guide groove 11 is formed on the rack 1 in a form of a recessing groove, as shown in FIG. 10, and when the rack 1 is lowered to the lower end of the guide rail, the locking platform 23 of the guide rail 1 will be locked on the bottom of the rack 1, that is, the bottom of the rack 1 is directly supported by the locking platform 23, and thus the rack 1 may still be fixed. This may be understood by those skilled in the art. Therefore, such a variation shall be included within the protection scope of the appended claims of the present disclosure.

Embodiment 6

Figure 9:
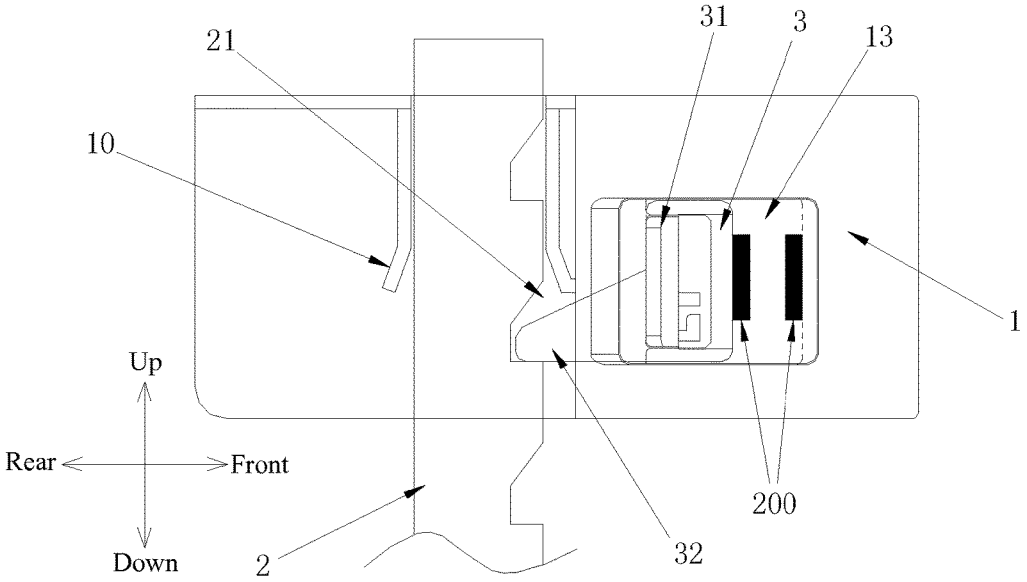
FIG. 9 is an internal structural diagram of controlling a manipulating member by magnetism of magnets, according to Embodiment 6.

The structure of this embodiment is similar to that of Embodiment 1. The difference between this embodiment and Embodiment 1 lies in that there is no spring leaf within the mounting site, instead, as shown in FIG. 9, magnets 200 corresponding to each other are fixedly connected on the front side of the mounting site 13 and on the front side of the manipulating member 3, respectively. The opposite ends of the two magnets 200 have the same polarity, so that a repulsion is generated between the two magnets 200. Due to the magnetic repulsion, the manipulating member 3 is pushed to drive the stop block 32 to enter the adjusting groove 21. Similarly, when the handle 31 is manually controlled to drive the manipulating member 3 to move toward the front side, the magnetic repulsion of the two magnets 200 may be overcome, so that the stop block 32 may be controlled to retreat from the adjusting groove 21. When the handle 31 is released, the two magnets 200 may be restored to the original state, and then the stop block 32 continues to be driven to enter an adjusting groove 21 due to the magnetic repulsion. In addition, it is noted that, in this embodiment, the magnetic attraction of two magnets may also be utilized to drive the manipulating member to move backward. As long as two magnets 200, which are attracted to each other, are fixed on the left side of the mounting side 13 and on the left side of the manipulating member 3, respectively, the manipulating member 3 may be attracted to the left side of the mounting side 13 such that the stop block 32 is driven to enter the adjusting groove 21. Similarly, as long as the handle 31 is prodded toward the front side to drive the manipulating member 3, the attraction of the two magnets 200 may be overcome and the unlocking of the rack 1 is finally realized. By controlling the stop block by the magnetic force, the structure may become simpler, and the service life of the internal mechanism becomes longer. The working principle of the parts not mentioned in this embodiment is the same as that of in the Embodiment 1, and will not be repeated here.

Embodiment 7

Figure 11:
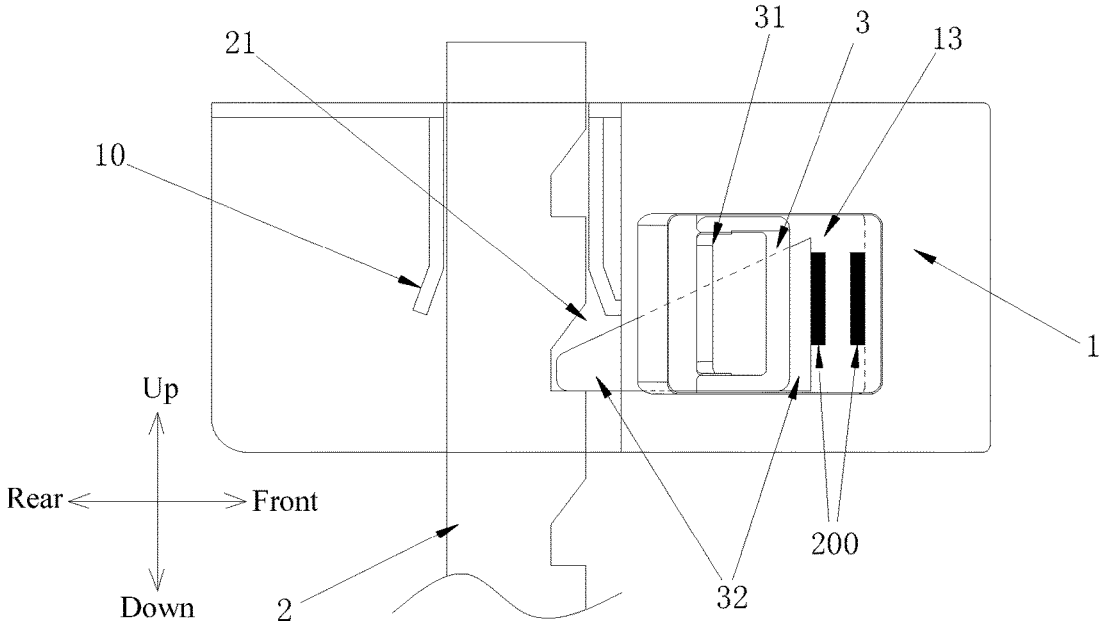
FIG. 11 is an internal structural diagram of controlling a stop block by magnetism of magnets, according to Embodiment 7.

As shown in FIG. 11, the structure of this embodiment is similar to that of Embodiment 6. The difference between this embodiment and Embodiment 6 lies in that the stop block 32 extends forward and beyond the manipulating member 3 by a certain section, and magnets 200 corresponding to each other are fixedly connected on the front side of the mounting site 13 and on the front side of the stop block 5, respectively. The opposite ends of the two magnets 200 have the same polarity, so that a repulsion is generated between the two magnets. Due to the magnetic repulsion, the stop block 32 is directly pushed into the adjusting groove 21. Similarly, when the handle 31 is manually controlled to drive the manipulating member 3 to move forward, the stop block 32 may be driven to move forward to overcome the magnetic repulsion of the two magnets 200 and to retreat from the adjusting groove 21. When the handle 31 is released, the two magnets 200 will repel each other, and the magnetic repulsion drives the stop block 32 to move backward and enter an adjusting groove 21 again, and the stop block 32 may also drive the handle 31 to move backward and then to restore to the original state.

Similarly, similar to Embodiment 6, just by correspondingly changing the positions of the two magnets 200, in this embodiment, the stop block may be driven to move backward by the magnetic attraction of two magnets. This may be understood by those skilled in the art and will not be repeated here.

Embodiment 8

Figure 12:
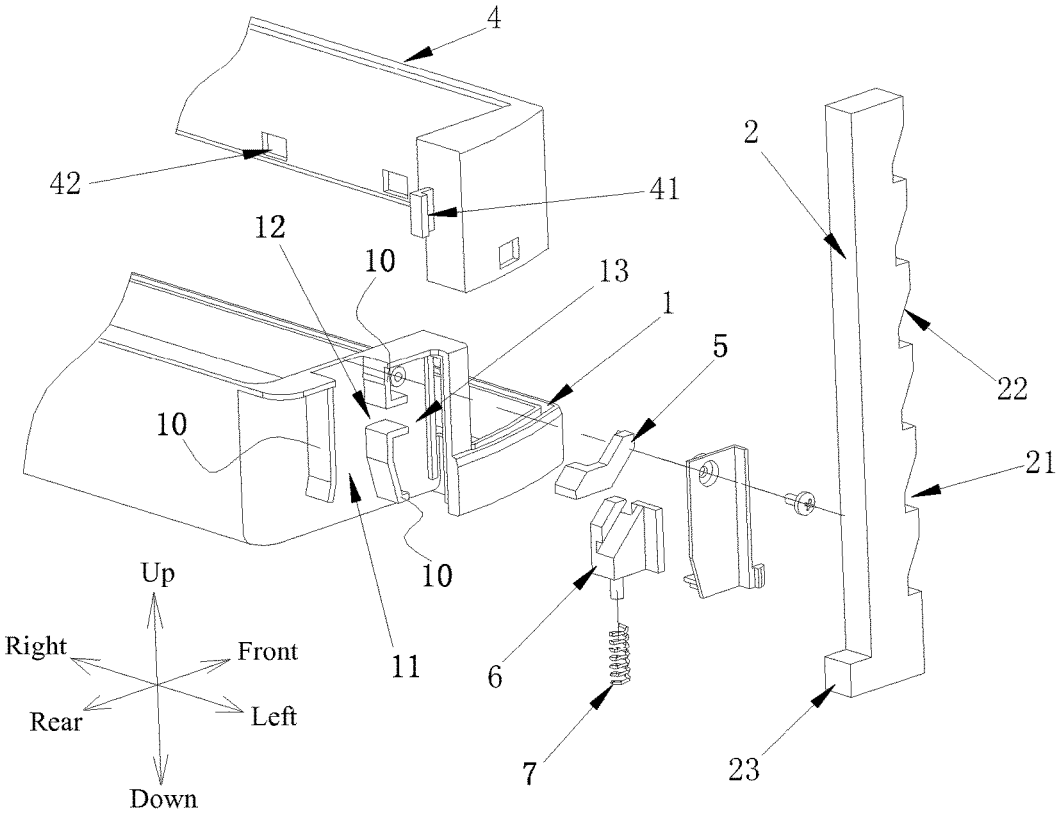
FIG. 12 is an exploded view according to Embodiment 8 of the present disclosure.
Figure 13:
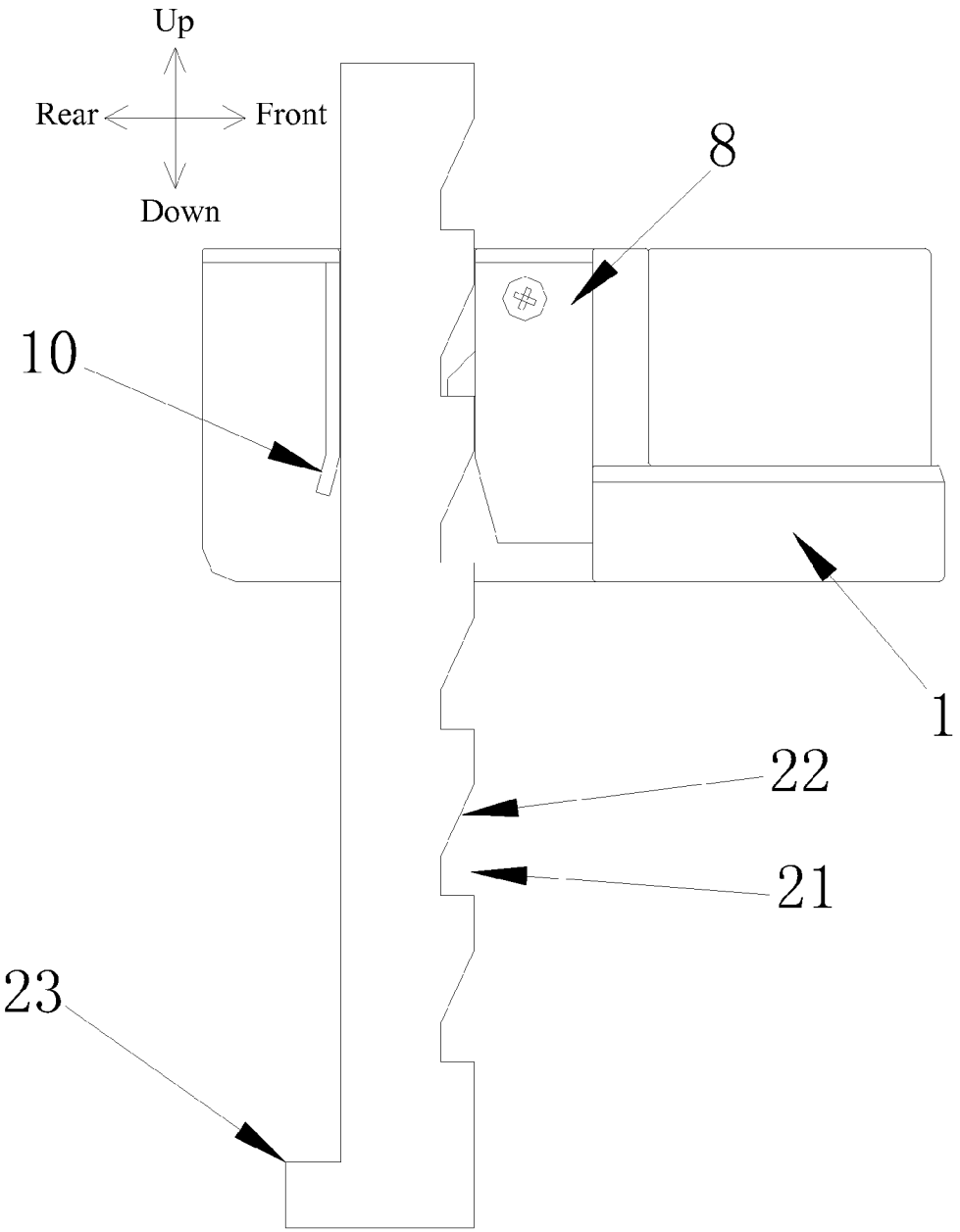
FIG. 13 is a side view according to Embodiment 8 of the present disclosure.

This embodiment is another implementation of the present disclosure. The differences between this embodiment and the above embodiments lie in that, as shown in FIG. 12, the limiting ribs 10 are spaced apart from each other and a transverse groove 12 is provided on the front side of the guide groove 11. The transverse groove 12 is formed in a manner of spacing two limiting ribs apart from each other. The transverse groove 12 is arranged horizontally, and the rear end of the transverse groove 12 is communicated with the guide groove 11. In addition, on the rack 1, a mounting site 13 is further defined by a number of limiting ribs. The mounting site 13 is located on the front side of the guide groove 11, the transverse groove 12 is located within the mounting site 13, and the transverse groove 12 communicates the guide groove 11 and the mounting site 13. As shown in FIG. 13, the rack 1 is assembled on the guide rail 2 through the fit of the guide groove 11 with the guide rail 2, and the rack 1 is able to move up and down in the direction of the guide rail 2. It is noted that, in practice, to avoid the inclination of the rack 1 during moving up and down, the guide rail 2 needs to be closely fitted with the guide groove 11. This may be understood by those skilled in the art. As shown in FIGS. 14-17, a stop block 5, formed by connecting a horizontal block 51 and an inclined block 53, is mounted within the mounting site 13. The horizontal block 51 is assembled within the transverse groove 12 and is able to move front and back within the transverse groove 12. The transverse groove 12 plays a role of guiding the stop block 5 so that the stop block 5 keeps moving transversely. As the transverse groove 12 limits the degree of freedom of the stop block 5 in up-and-down direction, the stop block 5 may be connected onto the rack 1, and the direction of movement of the stop block 5 may be defined. When the horizontal block 51 is moved backward, the horizontal block 51 may enter the guide groove 11 from a side edge through the transverse groove 12. The inclined block 52 of the stop block 5 obliquely extends toward the front side from the front end of the horizontal block 51. The lower side of the inclined block 52 forms an inclined plane, and the right side of the inclined block 52 extends vertically rightward to form a step 53. The upper side of the step 53 also forms an inclined plane, and the two inclined planes are parallel to each other. A connecting block 6, which is able to move up and down within the mounting site 13, is assembled on the lower side of the inclined block 52 within the mounting site 13. A chute 61 is formed on the upper side of the connecting block 6, with a direction of inclination of the chute 61 being parallel to the inclined planes on the upper and lower sides of the inclined block 52. The stop block 5 is mounted within the chute 61 through the fitting of the step 53 of inclined block 52 so as to realize the connection of the stop block 5 to the connecting block 6. The inclined plane on the upper side of the step 53 and the inclined plane on the lower side of the inclined block 52 are in close fit with the inclined planes of the upper and lower inner sides of the chute 61. In addition, it is noted that, in this embodiment, defining the guide groove 11 and the transverse groove 12 by a number of limiting ribs 10 is merely one of implementations; and in practical applications, this may be realized by various structures. For example, the guide groove 11 and the transverse groove 12 may be formed by recessing on the rack 1. Such a variation shall be included within the protection scope of the present disclosure.

A reset device is provided on the bottom of the connecting block 6. In this embodiment, the reset device is an elastic element which is a spring 7. The lower side of the connecting block 6 extends downward to form a guide column 62 on which the spring 7 is sheathed, a guide base 81 is provided on the bottom of the mounting site 13, and the guide column 62 is assembled within the guide base 81. The fit of the guide base 81 and the guide column 62 may play a role of guiding the connecting block 6, so that the connecting block 6 may be moved vertically. Meanwhile, the lower end of the spring 7 is resisted against the guide base 81, and the bottom of the connecting block 6 may be thus pushed and supported by the spring 7.

Figure 18:
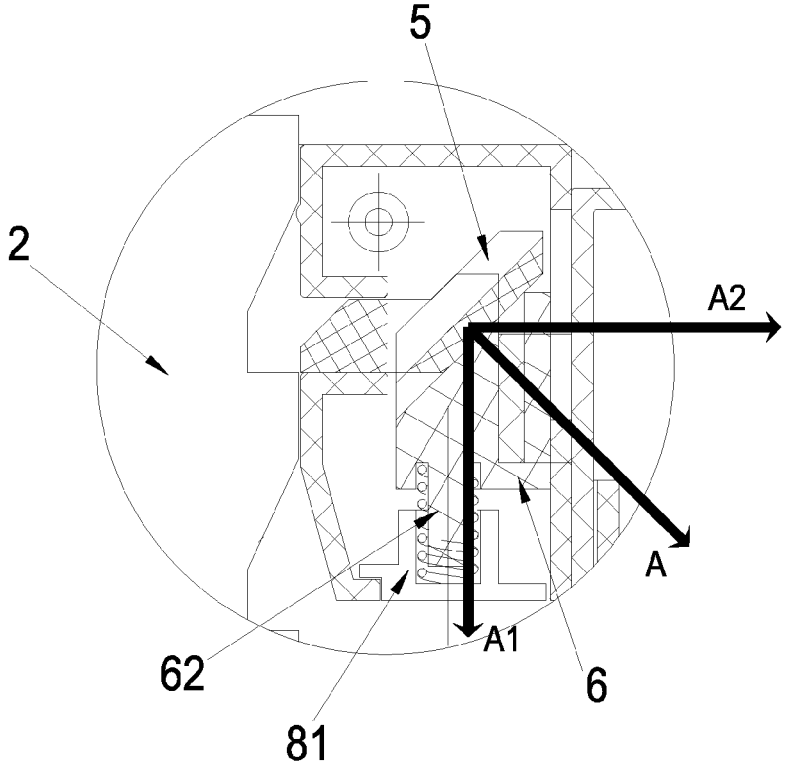
FIG. 18 is a force diagram when the manipulating member is interlocked with the stop block according to Embodiment 8 of the present disclosure.
Figure 19:
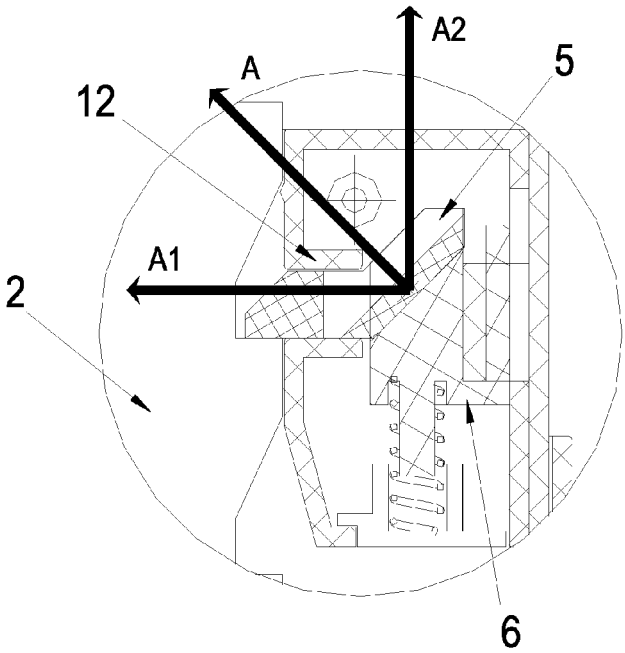
FIG. 19 is a force diagram when the manipulating member is interlocked with the stop block according to Embodiment 8 of the present disclosure.

The connecting block 6 and the stop block 5 may realize interlocking through the mutual pushing of the inclined planes. When an external acting force is applied to urge the connecting block 6 to move up and down or the stop block 5 to move front and back, the connecting block 6 and the stop block 5 are interlocked with each other through the fit of the inclined planes. During the interlocking, the inclined plane on the stop block 5 or the surface, in contact with the inclined plane of the stop block 5, within the chute 61 will be subject to an acting force A vertical to the inclined plane. With reference to FIG. 18, for example, when the stop block 5 is moved forward and pushes the inclined plane of the chute 61 of the connecting block 6, the acting force A may be decomposed into two components A1 and A2, where the direction of the component A1 is consistent with the direction of movement of the connecting block while the direction of the component A2 is forward, and the component A2 will be counteracted by a guide structure at the mounting site 13. In this embodiment, the guide structure is a fit structure of the guide base 81 and the guide column 62, the fit structure limiting the direction of movement of the connecting block 6. With reference FIG. 19, for another example, when the connecting block 6 is moved up and pushes the inclined plane of the step 53 of the stop block 5, the acting force A may also be decomposed into two components A1 and A2, where the direction of the component A1 is consistent with the direction of movement of the stop block 5 while the direction of the component A2 is vertical and upward, and the component A2 will be counteracted by a guide structure at the mounting site 13. In this embodiment, the guide structure is the transverse groove 12 for limiting the direction of movement of the stop block 5. Therefore, either the stop block 5 or the connecting block 6 serves as a driving member, a pushing component in a direction different from the direction of its movement may be generated through the inclined plane during movement, and the pushing component drives the pushed one to move along its own direction of movement. Therefore, even if the stop block 5 and the connecting block 6 have different directions of movement, the interlocking may also be realized by the pushing component generated by the inclined planes. In addition, during the interlocking, in order to keep the respective intended directions of movement of the stop block 5 and the connecting block 6, the stop block 5 and the connecting block 6 will relatively slide along the inclined planes, so that it is ensured that the interlocking of the connecting block 6 and the stop block 5 will not be hindered. As openings are formed at both ends of the chute 61, the inclined planes may smoothly slide relatively when the connecting block 6 and the stop block 5 are interlocked.

In addition, in this embodiment, a front rack cover 4 is movably mounted on the front side of the rack 1, a control arm 41 extending vertically is integrally formed on the rear side of the front rack cover 4, and a connecting groove 63 extending vertically is integrally formed on the front side of the connecting block 6. The control arm 41 of the front rack cover 4 passes through the rack 1 and reaches the mounting site 13, and is then fitted within the connecting groove 63. The bottom of the connecting groove 63 supports the control arm 41 so that the front rack cover 4 is allowed to be connected to the connecting block 6. Therefore, the front rack cover 4 and the connecting block 6 are connected together to form the manipulating member. Both the front rack cover 4 and the connecting block 6 may be vertically moved on the rack 1, so that a user may control the movement of the stop block 5 just by controlling the movement of the front rack cover 4 in front of the refrigerator door. The way of splitting the manipulating member into a connecting block 6 and a front rack cover 4 may provide the user an intuitive operating object, so that the user may operate the rack 1 just by controlling the front rack cover 4 having a larger size. Hence, it is convenient for the user to operate. Of source, it is to be emphasized that, the front rack cover 4 merely serves as an auxiliary element. Indeed, a control element equivalent to the front rack cover 4 may also be movably mounted on the rack 1, or directly, the connecting block 6 is movably controlled. In addition, after the control arm 41 is assembled into the connecting groove 63, the connecting block 6 and the front rack cover 4 are allowed to be moved vertically only, and this also plays a role of guiding the connecting block 6 and counteracts the component A2 of the inclined plane parallel to the chute 61.

Figure 14:
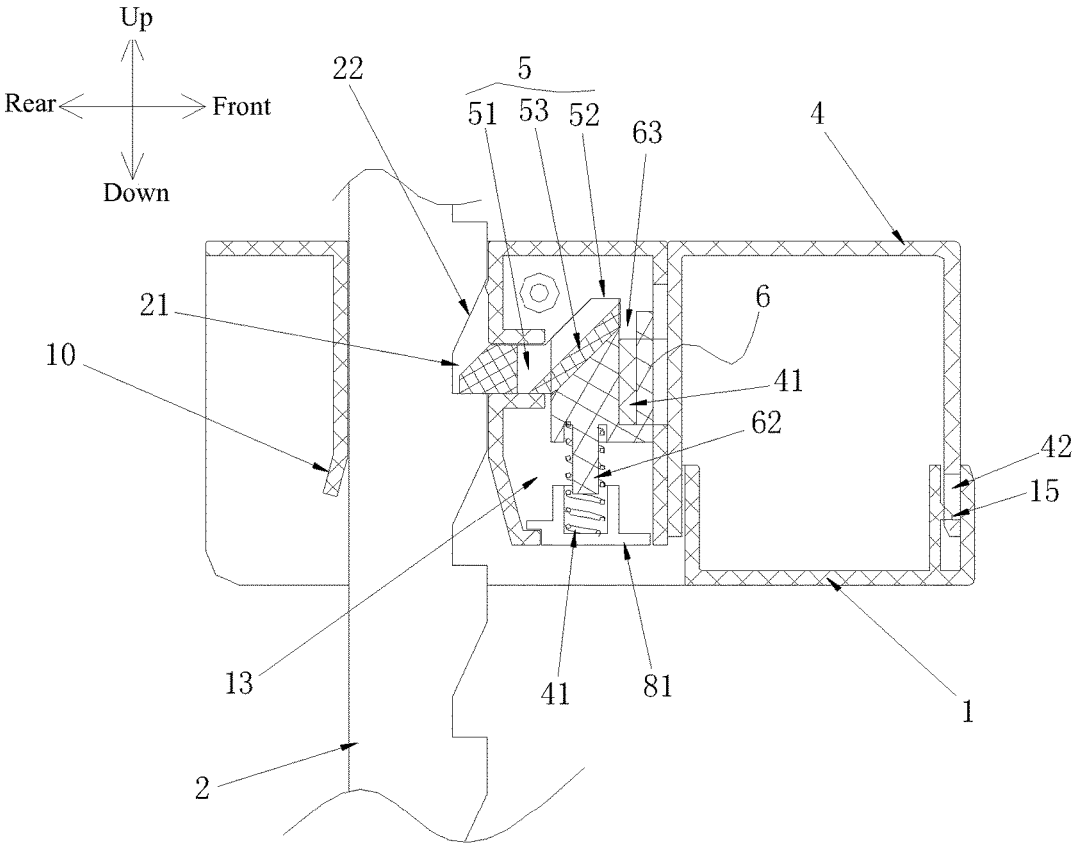
FIG. 14 is an internal structural diagram when the rack is locked at a certain height, according to Embodiment 8 of the present disclosure.
Figure 15:
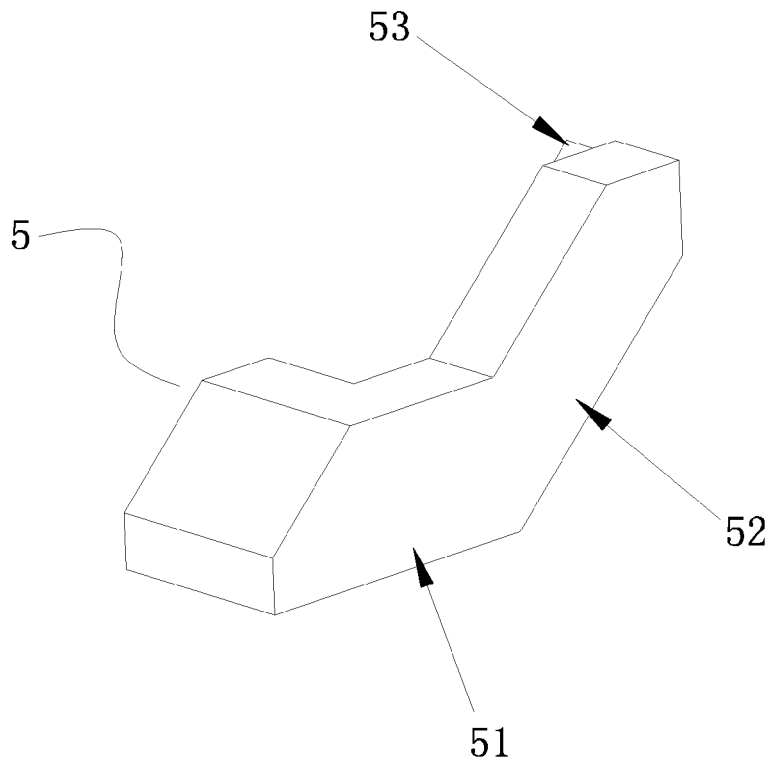
FIGS. 15-16 are structural diagrams of a stop block according to Embodiment 8 of the present disclosure.
Figure 16:
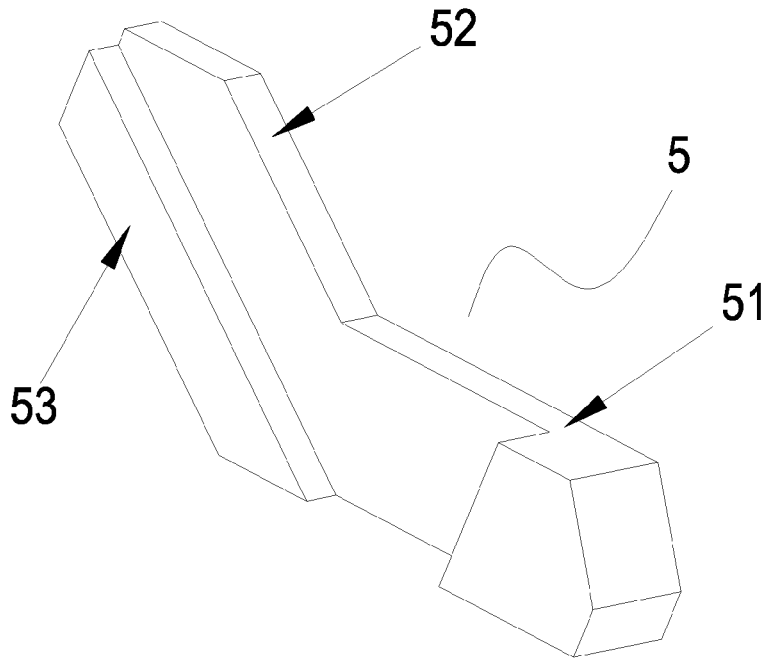
Figure 17:
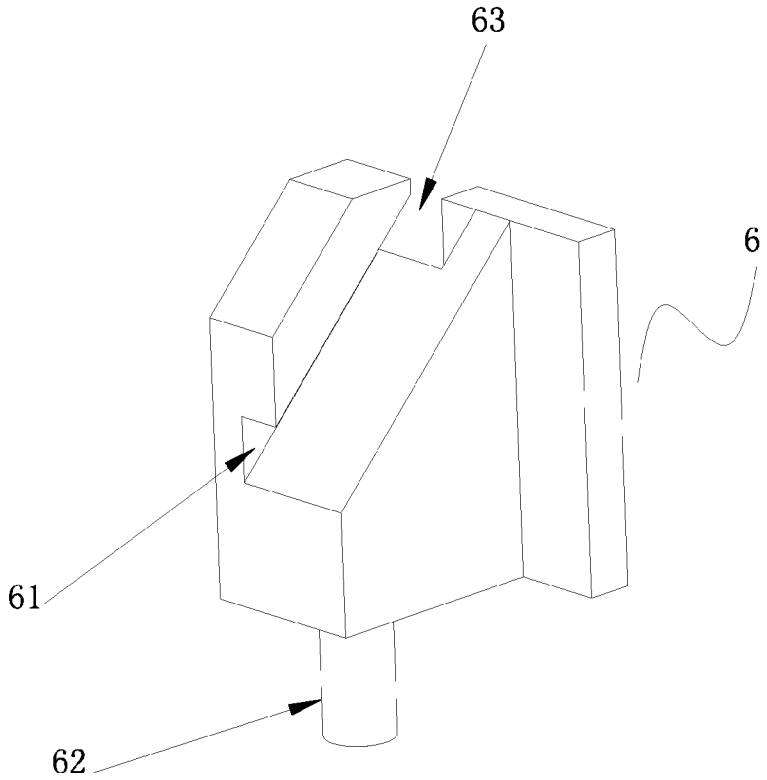
FIG. 17 is a structural diagram of a connecting block according to Embodiment 8 of the present disclosure.
Figure 20:
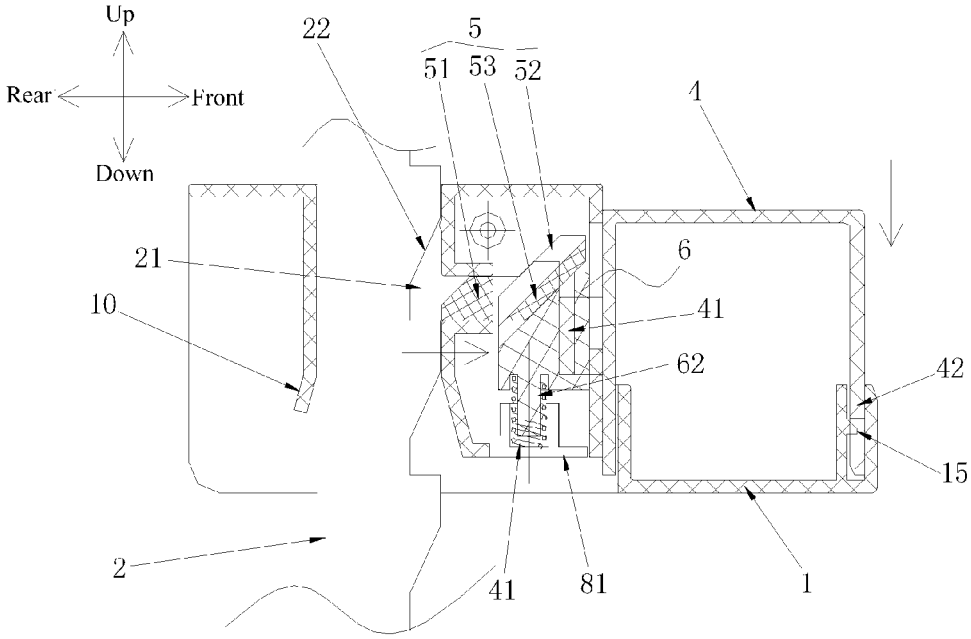
FIG. 20 is a structural diagram when the spring is compressed and the stop block is retreated from the adjusting groove, according to Embodiment 8 of the present disclosure.
Figure 21:
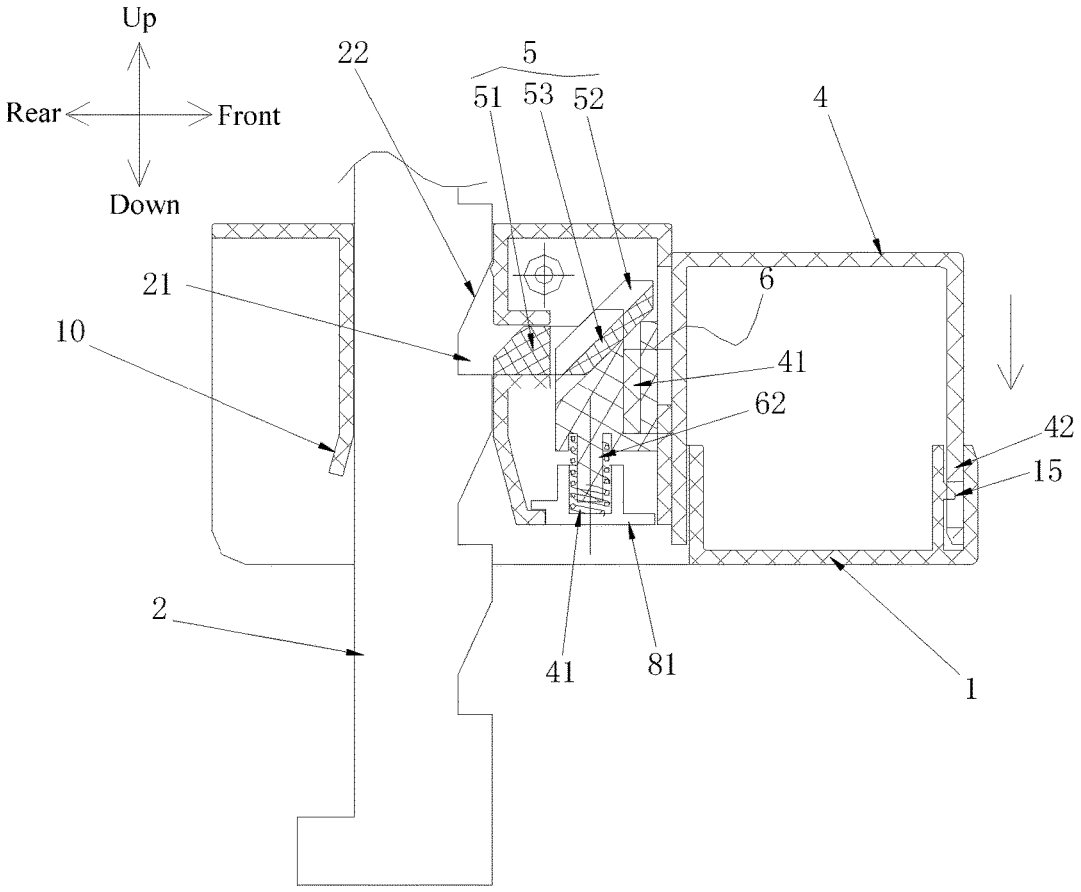
FIG. 21 is a schematic diagram of moving the rack downward according to Embodiment 8 of the present disclosure.
Figure 22:
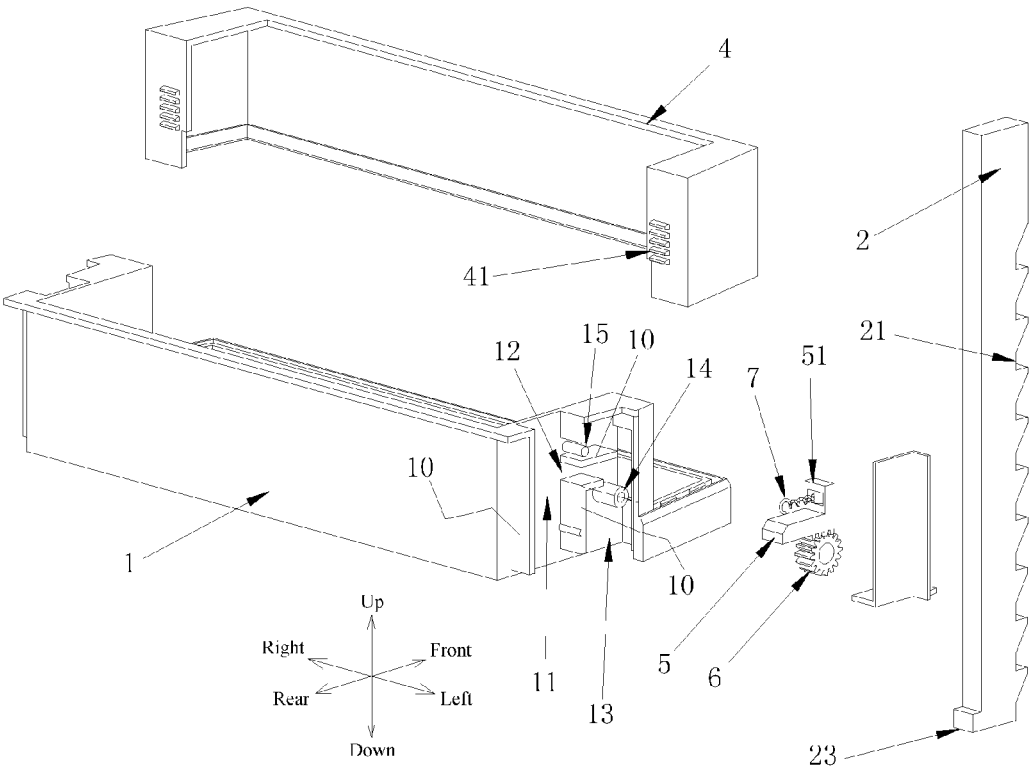
FIG. 22 is an exploded view according to Embodiment 9 of the present disclosure.
Figure 23:
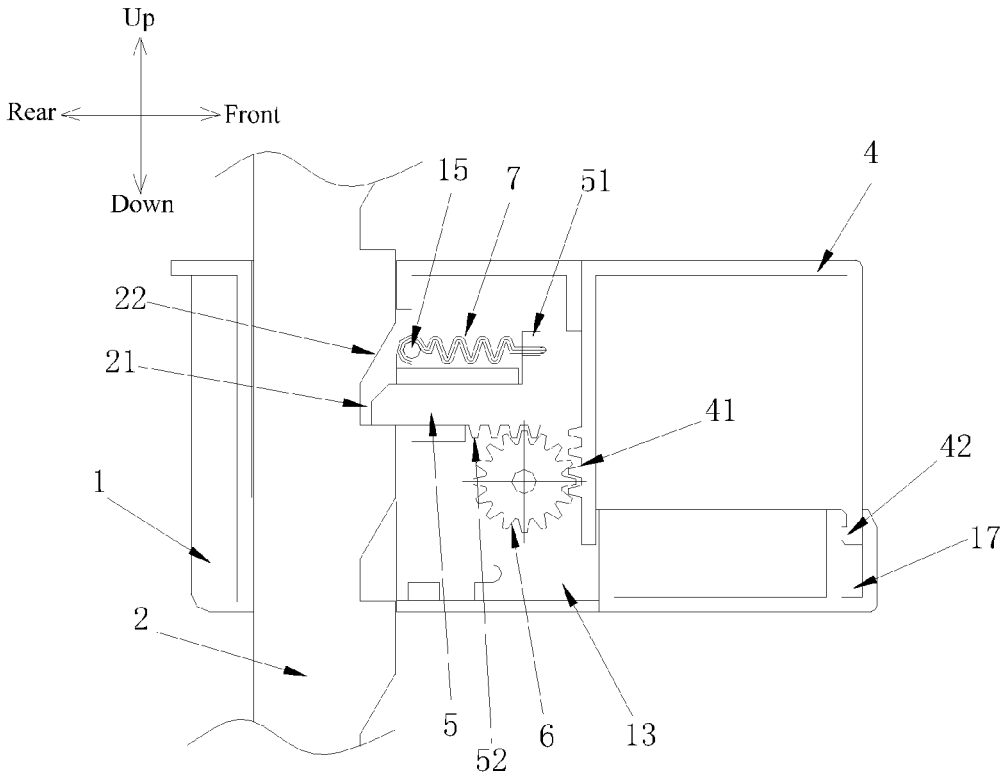
FIG. 23 is an internal structural diagram when the rack is locked at a certain height, according to Embodiment 9 of the present disclosure.
Figure 24:
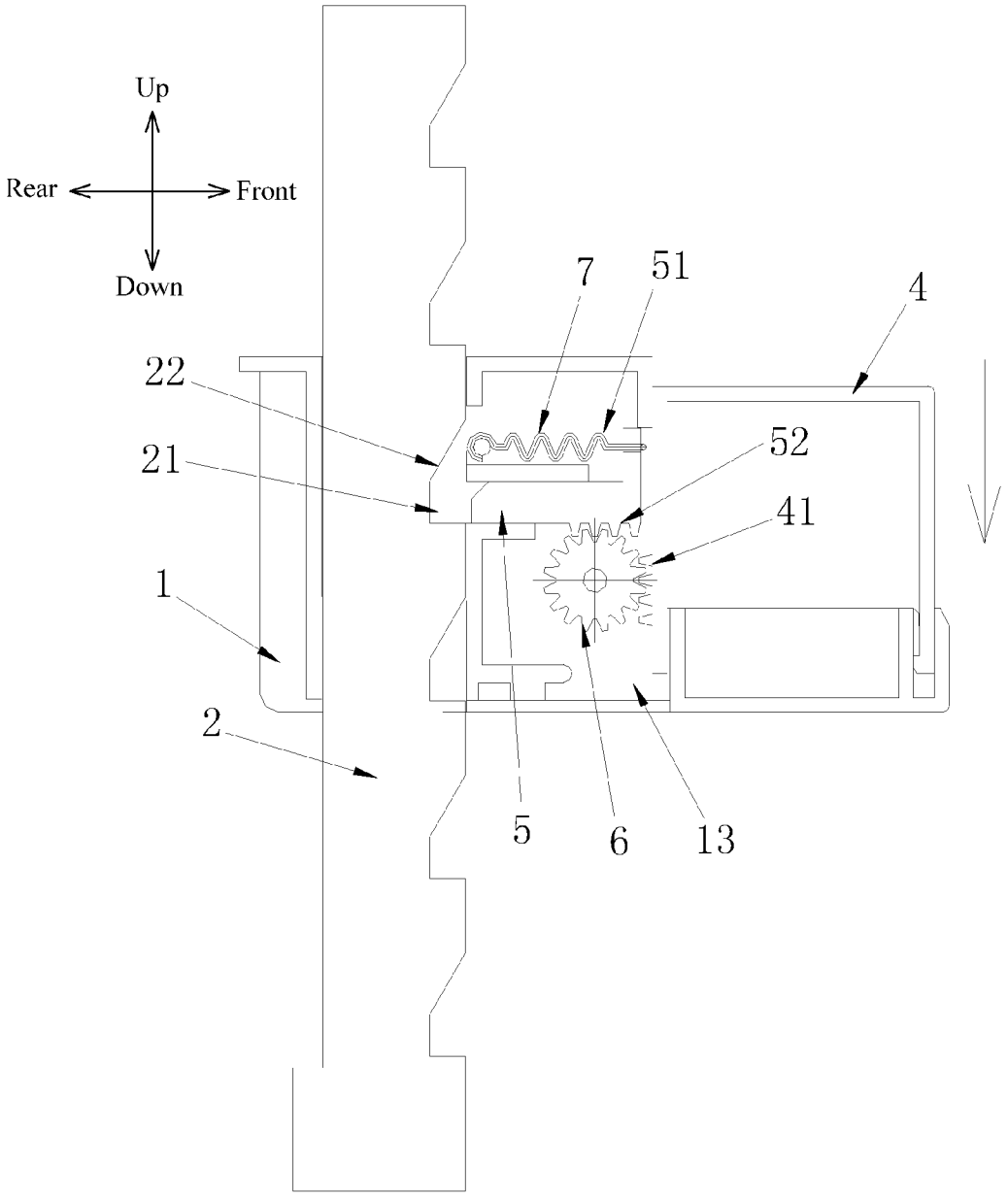
FIG. 24 is an internal structural diagram when the tension spring is stretched and the stop block is retreated from the adjusting groove, according to Embodiment 9 of the present disclosure.
Figure 25:
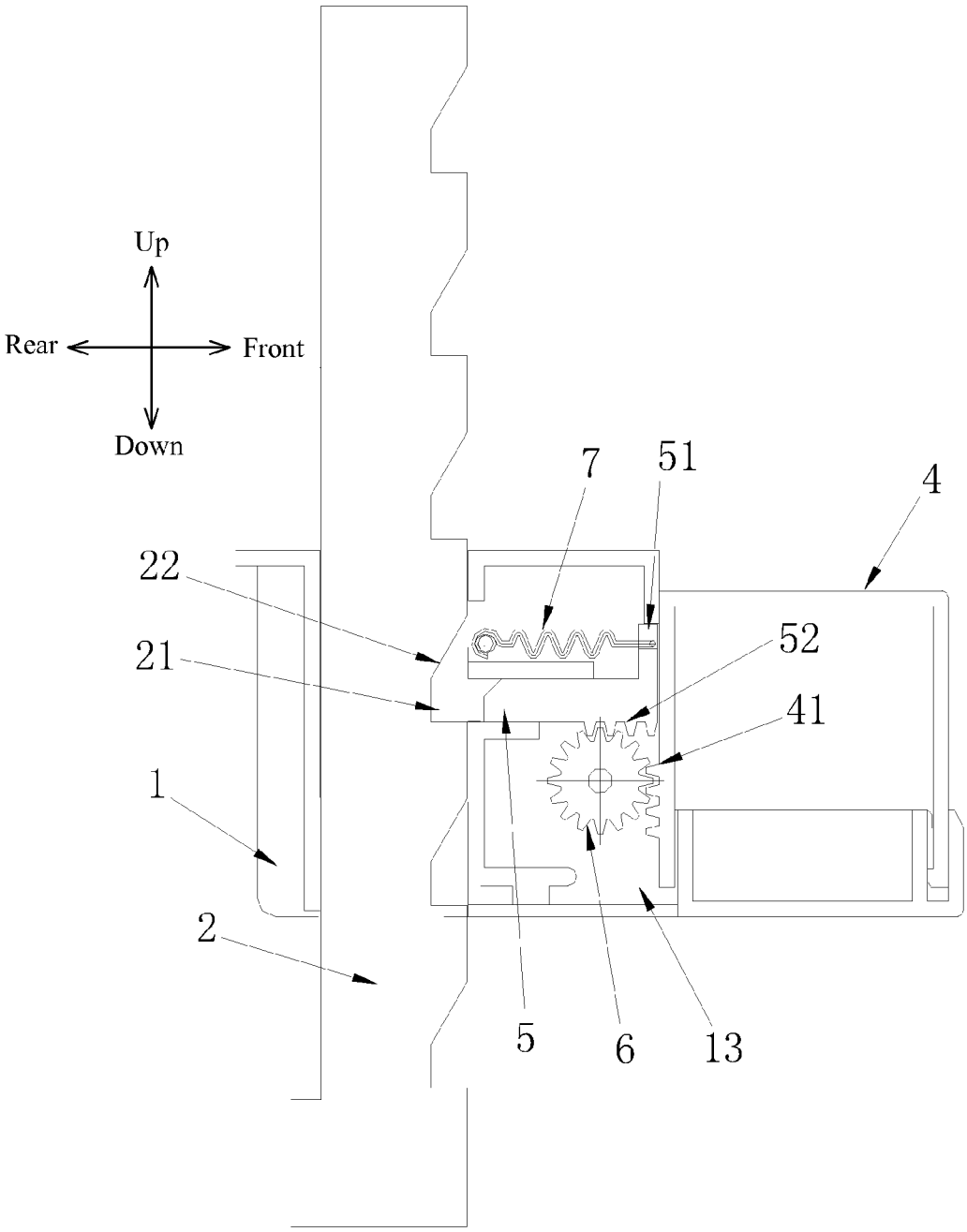
FIG. 25 is a schematic diagram of moving the rack downward according to Embodiment 9 of the present disclosure.

The working principle of this embodiment is as follows: as shown in FIG. 14, when rack 1 is placed on the guide rail 2, the spring 7 drives the connecting block 6 from the lower side to stay at a certain height, and the connecting block 6 pushes the stop block 5 to enter any one of the adjusting grooves 21 of the guide rail 2 through the fit with the inclined planes. As the stop block 5 is supported by the adjusting groove 21 on the bottom, the whole rack 1 may be retained at a certain height. Furthermore, as the guide rail 2 is closely fitted into the guide groove 11, the rack 1 will be retained on the guide rail 2 without inclining downward. With reference to FIG. 20 and FIG. 21, when it is required to adjust the height of the rack 1, the front rack cover 4 is pressed downward from the upper side and thus moved downward. As the front rack cover 4 is connected to the connecting block 6, the front rack cover 4 drives the connecting block 6 to move downward, and meanwhile overcomes the support force of the spring 7 to the bottom of the connecting block 6. The connecting block 6 is interlocked with the stop block 5 while moving downward, and during the interlocking, the inclined plane on the upper side of the chute 61 gradually pushes the inclined plane on the upper side of the step 53 downward, and thus generates downward and forward acting forces to the inclined plane on the upper side of the step 53. As the transverse groove 12 counteracts the downward acting force, the connecting block 6 is pushed forward and then retreated from the adjusting groove 21, so that the stop block 5 will not be limited by the adjusting groove 21 and the rack 1 may be thus moved downward. When the rack 1 is moved to a proper height, the spring 7 may be restored to push the connecting block 6 on the bottom again, as long as no any downward acting force is applied to the front rack cover 4, so that the inclined plane on the lower side of the chute 61 of the connecting block 6 applies upward and backward acting forces to the inclined plane on the lower side of the inclined block 52. As the transverse groove 12 counteracts the upward acting force, the stop block 5 is moved backward and pushed into the adjusting groove 21, eventually. As the stop block 5 is connected to the rack 1, after the stop block 5 is locked within the adjusting groove 21, the rack 1 may be thus kept at a new vertical height. In this way, since the height position of the rack 1 on the door 100 may be adjusted at will, the user may adjust the height position of the rack 1 without taking down the rack 1 from the door 100, so that the problem of inconvenient operation of the rack on the conventional refrigerator door is solved. Furthermore, a high article may be placed on the rack 1 normally by adjusting the distance between racks, instead of being deliberately and horizontally placed on the rack. Hence, the utilization ratio of the space inside the refrigerator is effectively improved.

This embodiment has recorded an implementation where the manipulating member and the stop block are interlocked in different directions of movement. In other words, in the present disclosure, the direction of movement of the manipulating member may be not limited by the direction of movement of the stop block. Thus, the direction of movement of the manipulating member on the rack may be configured to fit an operating gesture of a user, so that the direction of application of a force by a finger/hand of the user is consistent with the direction of movement of the manipulating member, rather than being unnecessarily identical to the direction of movement of the stop block, when the user operates the manipulating member, thereby realizing the convenient adjustment of the rack. Such a variation may solve the technical problem to be solved by the present disclosure, and shall be included within the protection scope of the present disclosure.

Embodiment 9

This embodiment is another implementation of the present disclosure. The differences between this embodiment and the above embodiments lie in that, as shown in FIGS. 22-25, a stop block 5 is provided within a mounting site 13, and the stop block 5 is assembled within a transverse groove 12 and is able to move horizontally along the transverse groove 12; the stop block 5 is limited by the transverse groove 12 in vertical direction; and a first transmission belt is formed on the lower side of the stop block 5. In this embodiment, first transmission teeth 51 arranged transversely are formed on the first transmission belt. A pivot shaft 14, which vertically extends leftward and is located on the lower side of the stop block 5, is provided at the mounting site 13, and a transmission member is pivoted to the pivot shaft 14. In this embodiment, the transmission member is a gear 6 engaged with the first transmission teeth 52 of the first transmission belt on the upper side. An elastic element is further mounted within the mounting site 13. In this embodiment, the elastic element is a tension spring 7. A spring base 15 is extended from a position rearward of the mounting site 13, and a shoulder 51 is extended upward from the front side of the stop block 5. The front end of the tension spring 7 is connected to the shoulder 51 of the stop block 5, while the rear end thereof is hooked onto the spring base 14 at the mounting site 13. In the case where the tension spring 7 is not tensioned, a pre-tensioning force of the tension spring 7 may strain the stop block 5, in order to drive the stop block 5 to enter the adjusting groove 21 of the guide rail 2. As the bottom of the adjusting groove 21 is in plane fit with the bottom of the stop block 5, the adjusting groove 21 supports the stop block 5 on the bottom, so that the whole rack 1 may be retained at any height of the guide rail 2. Furthermore, as the guide rail 2 is in close fit with the guide groove 11, the rack 1 will be retained on the guide rail 2 without inclining downward.

In addition, a manipulating member is movably provided on the rack. In this embodiment, the manipulating member is a front rack cover 4 movably mounted on the front side of the rack 1. The front rack cover 4 may be moved vertically on the rack 1, and the rear side of the front rack cover 4 is located within the mounting site 13. Furthermore, a second transmission belt located on the front side of the gear 6 is provided. In this embodiment, second transmission teeth 41, which are engaged with the gear 6, are vertically arranged on the second transmission belt. Using the front rack cover 4 as a manipulating member may provide the user an intuitive operating object, so that the user may operate the rack 1 just by controlling the front rack cover 4 having a larger size. Hence, it is convenient for the user to operate.

When it is required to adjust the height of the rack 1, the front rack cover 4 is pressed downward by a hand and thus moved toward the lower side, the second transmission teeth 41 is moved downward along with the front rack cover 4 and drives the gear 6 to rotate clockwise, and the gear drives the first transmission teeth 52 and thus drives the stop block 5 to move forward. Meanwhile, the tension spring 7 is stretched to store elastic potential energy. The stop block 5 is retreated from the adjusting groove 21 after being moved forward, so that the adjusting groove 21 will not support the bottom of the stop block 5 any more and the rack 1 may be moved at will in the vertical direction. When the rack 1 is moved to a proper height, as long as the hand releases the acting force to the front rack cover 4, the tension spring 7 may be restored to pull the stop block 5 to move backward so as to drive the stop block 5 to enter an adjusting groove 21 again, so that the bottom of the stop block 5 is supported by the adjusting groove 21 again. Thus, the rack 1 may be retained at a new vertical height. In practical applications, as the guide rail 2 is in close fit with the guide groove 11, the rack 1 will be retained on the guide rail 2 without inclining downward. In this way, since the height position of the rack 1 on the door 100 may be adjusted at will, the user may adjust the height position of the rack 1 without taking down the rack 1 from the door 100, so that the problem of inconvenient operation of the rack of the conventional refrigerator door is solved. Furthermore, a high article may be placed on the rack 1 normally by adjusting the distance between racks, instead of being deliberately and horizontally placed on the rack. Hence, the utilization ratio of the space inside the refrigerator is effectively improved.

This embodiment has recorded an implementation where the manipulating member and the stop block are indirectly interlocked. In other words, in the present disclosure, the manipulating member and the stop block may be mutually controlled indirectly by a third element. Such a variation may solve the technical problem to be solved by the present disclosure, and shall be included within the protection scope of the present disclosure.

To be sure, the above several embodiments disclosed by the present disclosure could contact with each other so as to form some new embodiments. That is, the present disclosure could also comprise some combinations of the present embodiments, and those combinations shall be included within the protection scope of the present disclosure.

In the above one or more embodiments, by the arrangement of the guide rail extending vertically on the refrigerator door, and by the fit of the guide groove with the guide rail, the rack is allowed to move vertically along the guide rail; since a number of adjusting grooves are formed on the guide rail and a reset device and a stop block are provided on the rack, the rack may be locked at a certain height of the guide rail by driving the stop block to enter an adjusting groove by the reset device; since a manipulating member and a stop block, which are interlocked, are further movably provided on the rack, a user may overcome the driving force of the reset device and drive the stop block to leave the adjusting groove just by controlling the manipulating member, so as to unlock the rack and select a desired height for the rack; meanwhile, by releasing the manipulating member to reset the reset device, the limiting member enters an adjusting groove again, so that the rack is locked again. Therefore, the refrigerator provided by the present disclosure, as the height position of the rack may be quickly adjusted just by adjusting the manipulating member without taking down the rack, solves the problem of inconvenient operation of a rack on a conventional refrigerator door, and is simple in structure and easy to operate. Furthermore, when there is more than one rack on the door, the vertical distance between the racks may also be adjusted by adjusting the height positions of the racks, thereby meeting the requirements on storage of foods of different height and effectively improving the utilization ratio of the refrigerator.

Apparently, the foregoing embodiments of the present disclosure are examples merely for clearly describing the present disclosure and not intended to limit the implementations of the present disclosure. A person of ordinary skill in the art may make other different forms of variations or alterations on the basis of the foregoing description, and not all the implementations are exhaustive herein. Any modifications, equivalent replacements and improvements made within the spirit and principle of the present disclosure shall be included within the protection scope defined by the appended claims of the present disclosure.

What is claimed is:

1. A refrigerator, comprising:

a door on which a guide rail extending vertically is provided, a number of adjusting grooves being formed on the guide rail;

a rack on which a guide groove assembled on the guide rail is provided, the rack being able to move along the guide rail; wherein a manipulating member and a stop block, which are interlocked, are further movably provided on the rack; and a reset device provided on the rack, the reset device driving the stop block to enter one of the number of adjusting grooves;

wherein:

the stop block comprises a horizontal block, which is able to enter and retreat from the adjusting grooves, and an inclined block connected thereon; wherein a lower side of the inclined block forms an inclined plane, and one side of the inclined block extends horizontally rightward to form a step, an upper side of the step also forms an inclined plane which is parallel to the inclined plane on the lower side of the inclined block; the manipulating member comprises a connecting block, a chute is formed on an upper side of the connecting block, with a direction of inclination of the chute being parallel to the inclined planes on the upper and lower sides of the inclined block, the stop block is mounted within the chute through fitting the step of inclined block so that the inclined plane on the upper side of the step and the inclined plane on the lower side of the inclined block are in close fit with inclined planes of upper and lower inner sides of the chute so as to realize the connection of the stop block to the connecting block.

2. The refrigerator according to claim 1, wherein the upper side of the adjusting grooves has a depth value that is gradually increased from up to down and forms a driving surface, and the driving surface is able to push the stop block to move as the rack rises.

3. The refrigerator according to claim 2, wherein the driving surface is a plane or cambered surface.

4. The refrigerator according to claim 1, wherein an outside top end of the stop block is arc-shaped.

5. The refrigerator according to claim 1, wherein a locking platform, which protrudes toward a side edge of the guide rail, is formed at a lower end of the guide rail, and the locking platform is able to lock the rack when the rack is moved to the lower end of the guide rail.

6. The refrigerator according to claim 1, wherein the reset device is an elastic element, one end of which is resisted against the rack while the other end of which is connected to the manipulating member or the stop block.

7. The refrigerator according to claim 1, wherein the reset device comprises at least one pair of magnets which are provided on the manipulating member and the rack, respectively, or are provided on the manipulating member and the stop block, respectively, and are corresponding to each other, and the mutual repulsion of the two magnets drives the stop block to enter the adjusting groove.

8. The refrigerator according to claim 1, wherein the reset device comprises at least one pair of magnets which are provided on the manipulating member and the rack, respectively, or are provided on the manipulating member and the stop block, respectively, and are corresponding to each other, and the mutual attraction of the two magnets drives the stop block to enter the adjusting groove.

9. The refrigerator according to claim 1, wherein a direction of movement of the manipulating member and a direction of movement of the stop block form a certain included angle.

10. The refrigerator according to claim 1, wherein the guide groove is formed by a number of limiting ribs vertically extending toward an outer side which are integrally formed on one side of the rack and apart from each other; or, the guide groove is formed by recessing on the rack.

11. The refrigerator according to claim 1, wherein the lower side of the connecting block extends downward to form a guide column; and the reset device is an elastic element, which is sheathed on the guide column;

a guide base is provided on rack, and the guide column is assembled within the guide base.

12. The refrigerator according to claim 1, wherein the manipulating member further comprises a front rack cover movably connected to the front side of the rack, the front rack cover is connected to the connecting block, so that a user may control the movement of the stop block just by controlling the movement of the front rack cover.

13. The refrigerator according to claim 12, wherein a control arm extending vertically is integrally formed on the rear side of the front rack cover, a connecting groove extending vertically is integrally formed on the front side of the connecting block, and the control arm of the control block is fitted within the connecting groove.

14. The refrigerator according to claim 1, wherein a handle is extended from the manipulating member to the outside of the rack.

15. The refrigerator according to claim 1, wherein a transverse groove is horizontally provided on one side of the guide groove, and the transverse groove is communicated with the guide groove;

the horizontal block is assembled within the transverse groove and is able to move front and back within the transverse groove to enter or retreat from the guide groove.

16. The refrigerator according to claim 15, wherein the transverse groove is formed by a number of limiting ribs horizontally extending toward an outer side which are integrally formed on one side of the rack and apart from each other; or, the transverse groove is formed by recessing on the rack.

* * * * *